US007364254B2

(12) United States Patent
Yamazaki et al.

(10) Patent No.: US 7,364,254 B2
(45) Date of Patent: Apr. 29, 2008

(54) INKJET PRINTER AND INKJET PRINTER CONTROLLING METHOD

(75) Inventors: Takeshi Yamazaki, Hachioji (JP); Tetsushi Aoki, Hachioji (JP); Fujio Miyamoto, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 319 days.

(21) Appl. No.: 11/034,086

(22) Filed: Jan. 12, 2005

(65) Prior Publication Data

US 2005/0156983 A1 Jul. 21, 2005

(30) Foreign Application Priority Data

Jan. 20, 2004 (JP) ..... 2004-011686
Feb. 26, 2004 (JP) ..... 2004-051753

(51) Int. Cl.
*B41J 2/165* (2006.01)
*B41J 29/393* (2006.01)

(52) U.S. Cl. ..... 347/23; 347/19; 347/30; 347/33

(58) Field of Classification Search ..... 347/23
See application file for complete search history.

(56) References Cited

U.S. PATENT DOCUMENTS 5,455,608 A * 10/1995 Stewart et al. ..... 347/23
6,565,185 B1 * 5/2003 Endo ..... 347/23
6,652,064 B2 * 11/2003 Bruch et al. ..... 347/23
6,719,400 B2 * 4/2004 Inui et al. ..... 347/23
6,896,350 B2 * 5/2005 Gomez et al. ..... 347/23
6,938,971 B2 * 9/2005 Gom z et al. ..... 347/14

* cited by examiner

*Primary Examiner*—Matthew Luu
*Assistant Examiner*—Shelby Fidler
(74) *Attorney, Agent, or Firm*—Cantor Colburn LLP

(57) ABSTRACT

An inkjet printer includes: a recording head which includes jet openings for jetting ink; a sensor for detecting a jet opening causing jetting failure among the jet openings; a sucking mechanism for sucking the ink from each jet opening; a comparing section for comparing number of the detected jet opening causing jetting failure with predetermined number; and a control section for performing a sucking process where the sucking mechanism performs a sucking operation, for performing an examination process to count the jet opening causing jetting failure by the detection of the sensor and by simulated jetting of each jet opening, for performing a comparing process where the comparing section performs a comparing operation after the examination process, and for re-performing the examination process without performing the sucking process when judged in the comparing process that the number of the jet opening causing jetting failure is more than the predetermined number.

4 Claims, 16 Drawing Sheets

INKJET PRINTER AND INKJET PRINTER CONTROLLING METHOD

BACKGROUND OF THE INVENTION

1. Field of the Invention

The present invention relates to an inkjet printer and a controlling method thereof, the inkjet printer comprising a recording head for jetting ink from a plurality of jet openings, a sensor for examining jetting failure with respect to each jet opening of the recording head, and a sucking mechanism for sucking ink from each jet opening of the recording head.

2. Description of Related Art

An inkjet printer which forms an image on recording medium by jetting ink toward the recording medium from each jet opening provided in a recording head has been in practical use. Since an inkjet printer records an image by jetting ink from each jet opening of a recording head, among a plurality of jet openings, there are normal jet openings which normally jet ink and jetting openings which do not jet ink due to jetting failure. There are roughly two reasons which cause jetting failure. The first reason is generation of air bubble within a channel which is a passage to the jet opening. The second reason is clogging of ink at a jet opening where ink existing within the channel which is a passage to the jet opening gets more viscous or solidified when the recording head is left unused for a long period.

In order to recover from jetting failure of ink, an inkjet printer comprises a cleaning mechanism for cleaning the recording head. The cleaning mechanism is used to eliminate ink adhering around each jet opening by contacting a cap member to the recording head, sucking the ink from each jet opening of the recording head while making a sucking pump generate a sucking force to the cap member, and wiping the recording head with a wiper blade after the sucking.

In order to deal with the above-mentioned situation where the recording head is left unused for a long period, what is developed is one in which when a predetermined period passes since a certain timing, a cleaning mechanism automatically functions for performing the sucking of ink and the wiping of recording head (for example, see JP-Tokukai-2002-79693A).

Further, what is also developed is one in which a examining unit examines whether each of jet opening of the recording head is in a jetting failure state, prior to the sucking of ink and the wiping of recording head by the cleaning mechanism (for example, see JP-Tokukai-2002-79693A and JP-Tokukaihei-3-244546A). In the inkjet printer disclosed in the JP-Tokukai-2002-79693A, simulated jetting which jets ink without involving image recording is performed with respect to each jet opening in the recording head, and the examining unit examines whether there is ink jetting with respect to each jet opening and if the recording head has a jet opening causing jetting failure according to the examination result, the cleaning mechanism sucks ink and wipes the recording head, and on the contrary, if the recording head has no jet opening causing jetting failure, the cleaning head does not suck ink or wipe the recording head.

In the inkjet printer disclosed in JP-Tokukaihei-3-244546A, the examining unit examines whether there is ink jetting with respect to each jet opening and if the recording head has no jet opening causing jetting failure according to the examination result, image recording is performed without making the cleaning mechanism suck ink nor wipe the recording head. On the contrary, if the recording head has a jet opening causing jetting failure according to the examination result, the inkjet printer repeats the sucking of ink and the wiping of recording head by the cleaning mechanism until the examining unit detects no jet opening causing jetting failure.

However, even after the sucking of ink and the wiping of recording head are performed, there is a possibility of existence of a jet opening causing jetting failure. In particular, there is a case where a jet opening which is capable of jetting ink normally before the sucking of ink and the wiping of recording starts causing jetting failure after the sucking of ink and the wiping of recording head.

Further, as another method to recover from jetting failure of ink, there is a method to forcibly suck ink from each jet opening of the recording head. One example of such method is disclosed in JP-Tokukaihei-5-293968A. The method of JP-Tokukaihei-5-293968A makes the recording head perform the simulated jetting, measures temperature inside of the recording head at three moments which are: before the simulated jetting; right after the simulated jetting; and after predetermined period has passes since the simulated jetting, judges whether there is jetting failure according to a temperature variation among these three moments, and performs a process to recover from the jetting failure of the recording head by sucking ink from each jet opening of the recording head if it is judged that there is jetting failure.

However, with the method of JP-Tokukaihei-5-293968, ink is sucked always with a constant sucking force regardless of whatever cause of jetting failure (even if a cause of jetting failure is generation of air bubble or clogging of foreign material). Therefore, a recovering process corresponding to a cause of jetting failure is not performed, whereby there is inconvenience in conjunction with the recovering process. In other words, if a cause of jetting failure is generation of air bubble, it is possible to eliminate the air bubble with a comparatively low sucking force. However, in the case of sucking ink always at a certain sucking force more than the sucking force necessary for eliminating air bubble, ink which is not necessary for eliminating air bubble (ink which can be used for image recording) is to be uneconomically sucked, whereby it is ink wasting. On the other hand, if a cause of jetting failure is clogging of foreign material, it is necessary to have a comparatively high sucking force. If ink is sucked with a certain sucking force which is less than the sucking force necessary for eliminating foreign material, it is not possible to eliminate the foreign material.

SUMMARY OF THE INVENTION

An object of the present invention is to solve the above-mentioned problems, that is, to reduce the possibility of causing jetting failure. Another object of the present invention is to recover from jetting failure in correspondence with a cause of jetting failure.

In accordance with a first aspect of the present invention, an inkjet printer comprises: a recording head which comprises a plurality of jet openings for jetting ink; a sensor for detecting a jet opening causing jetting failure among the plurality of jet openings of the recording head; a sucking mechanism for sucking the ink from each jet opening of the recording head; a comparing section for comparing number of the jet opening causing jetting failure detected by the sensor, with predetermined number; and a control section for performing a sucking process in which the sucking mechanism performs a sucking operation, for performing an examination process to count the jet opening causing jetting failure by making the sensor detect the jet opening causing jetting failure and by making each jet opening of the recording head perform simulated jetting, for performing a comparing process in which the comparing section performs a comparing operation after the examination process, and for re-performing the examination process without performing the sucking process when it is judged in the comparing process that the number of the jet opening causing jetting failure is more than the predetermined number.

In accordance with a second aspect of the present invention, a method for controlling an inkjet printer comprising a recording head which comprises a plurality of jet openings for jetting ink, a sensor for detecting a jet opening causing jetting failure among the plurality of jet openings of the recording head, a sucking mechanism for sucking the ink from each jet opening of the recording head, and a control device for controlling operations of the sucking mechanism and the recording head, comprises: making the sucking mechanism perform a sucking operation; counting number of the jet opening causing jetting failure by making the recording head perform simulated jetting from each jet opening and by counting up the number when the jet opening causing jetting failure is detected by the sensor, after the sucking operation is performed; and comparing the counted number of the jet opening causing jetting failure with predetermined number, after the counting of the number, wherein when it is judged in the comparing that the number of the jet opening causing jetting failure is more than the predetermined number, the counting of the number is performed without performing the sucking operation.

Here, in regard to the printer and the controlling method thereof of the first and second aspects of the present invention, investigation was made on the transition with time of jet openings causing jetting failure which emerge in a recording head after ink is sucked from each jet opening of the recording head and the recording head is wiped. Its result is shown in FIG. 1. In FIG. 1, the horizontal axis indicates unused time (minutes) which has passed since the sucking process and wiping process are performed to the recording head, and the vertical axis indicates the number of jet openings causing jetting failure existing in the recording head. As shown in FIG. 1, it is easier to have jet openings causing jetting failure right after the sucking process and wiping process, and the time passes by, there is a tendency of reducing the number of jet openings causing jetting failure. In consideration of such tendency, in accordance with the printer and the controlling method thereof of the first and second aspects of the present invention, an examination process which counts the number of jet openings causing jetting failure is performed after the sucking process is performed, wherein if the number of jet openings causing jetting failure exceeds predetermined number, what is performed is not the sucking process again, but the examination process repeatedly. Thereby while the examination process is being repeated, the number of jet openings causing jetting failure is reduced.

According to the printer and the controlling method thereof of the first and second aspects of the present invention, an examination process which counts the number of jet openings causing jetting failure is performed after the sucking process is performed, wherein if the number of jet openings causing jetting failure exceeds predetermined number, the examination process is repeatedly performed. Therefore, while the examination process is being repeated, the number of jet openings causing jetting failure is reduced, whereby it is possible to reduce the possibility of causing jetting failure.

In accordance with a third aspect of the present invention, an inkjet printer comprises: a recording head which comprises a plurality of jet openings for jetting ink; a sensor for detecting a jet opening causing jetting failure among the plurality of jet openings of the recording head; a cleaning mechanism for cleaning the recording head; and a control section for making the sensor detect the jet opening causing jetting failure by making the recording head perform simulated jetting from each jet opening, for performing an examination process to count number of the jet opening causing jetting failure, for performing a cleaning process to make the cleaning mechanism perform a cleaning operation after the examination process is performed, for performing a second examination process which is identical to the examination process after the cleaning process is performed, for performing a judging process to judge whether the number of the jet opening causing jetting failure counted in the second examination process is not less than predetermined number after the second examination process is performed, and for determining a cleaning mode of the cleaning process which is performed after the judging process according to a result of the judging process.

According to the printer of the third aspect of the present invention, the control device performs two times of examination processes, which are the examination process and the second examination process. Therefore, it is possible to judge whether a jet opening causing jetting failure is common or not between before and after the sucking mechanism performs the sucking operation, whereby, according to the judgment result, it is possible to judge whether the cause of the jetting failure is generation of air bubble or clogging of foreign material. In other words, it is possible to judge that, if the jet opening causing jetting failure is common, the cause of the jetting failure is generation of air bubble, and if the jet opening causing jetting failure is not common, the cause of the jetting failure is clogging of foreign material. Then, after the second examination process, the sucking mechanism is actuated under a sucking mode being different from a sucking mode before the second examination process. Therefore, it is possible to change a sucking mode of the sucking mechanism according to a cause of jetting failure (whether generation of air bubble or clogging of foreign material). Further, according to the change of a sucking mode of the sucking mechanism based on the detection result by the sensor, it is possible to recover a jet opening according to a cause of jetting failure.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, the best mode for implementing the present invention will be described with reference to figures. However, although technically preferable various limitations are applied to an embodiment described hereafter for implementing the present invention, the scope of the invention is not limited to the embodiment hereafter or the illustrated examples.

Figure 1:
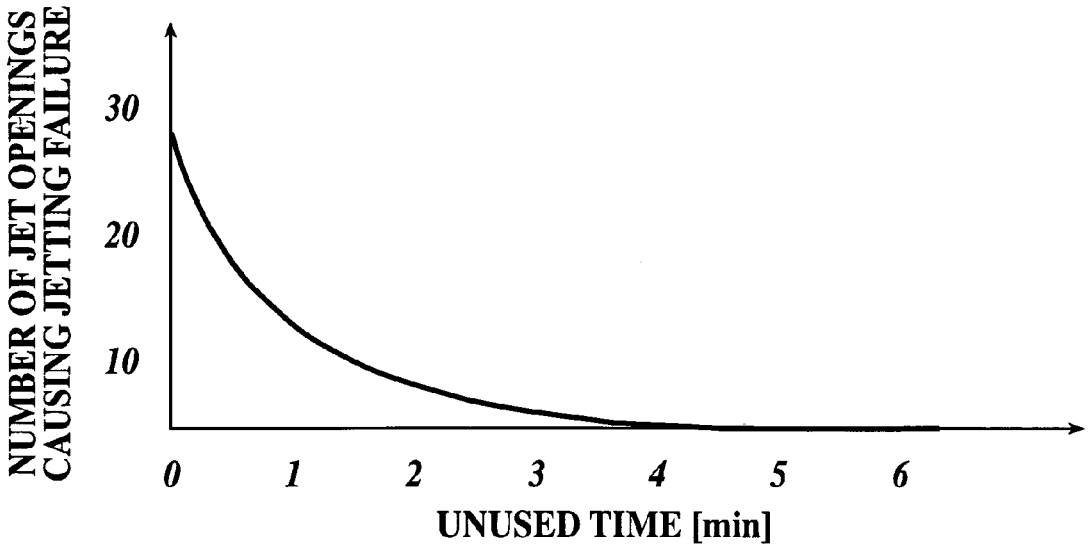
FIG. 1 is a graph showing a transition of the number of jet openings causing jetting failure in a recording head after a sucking and wiping process is performed.
Figure 2:
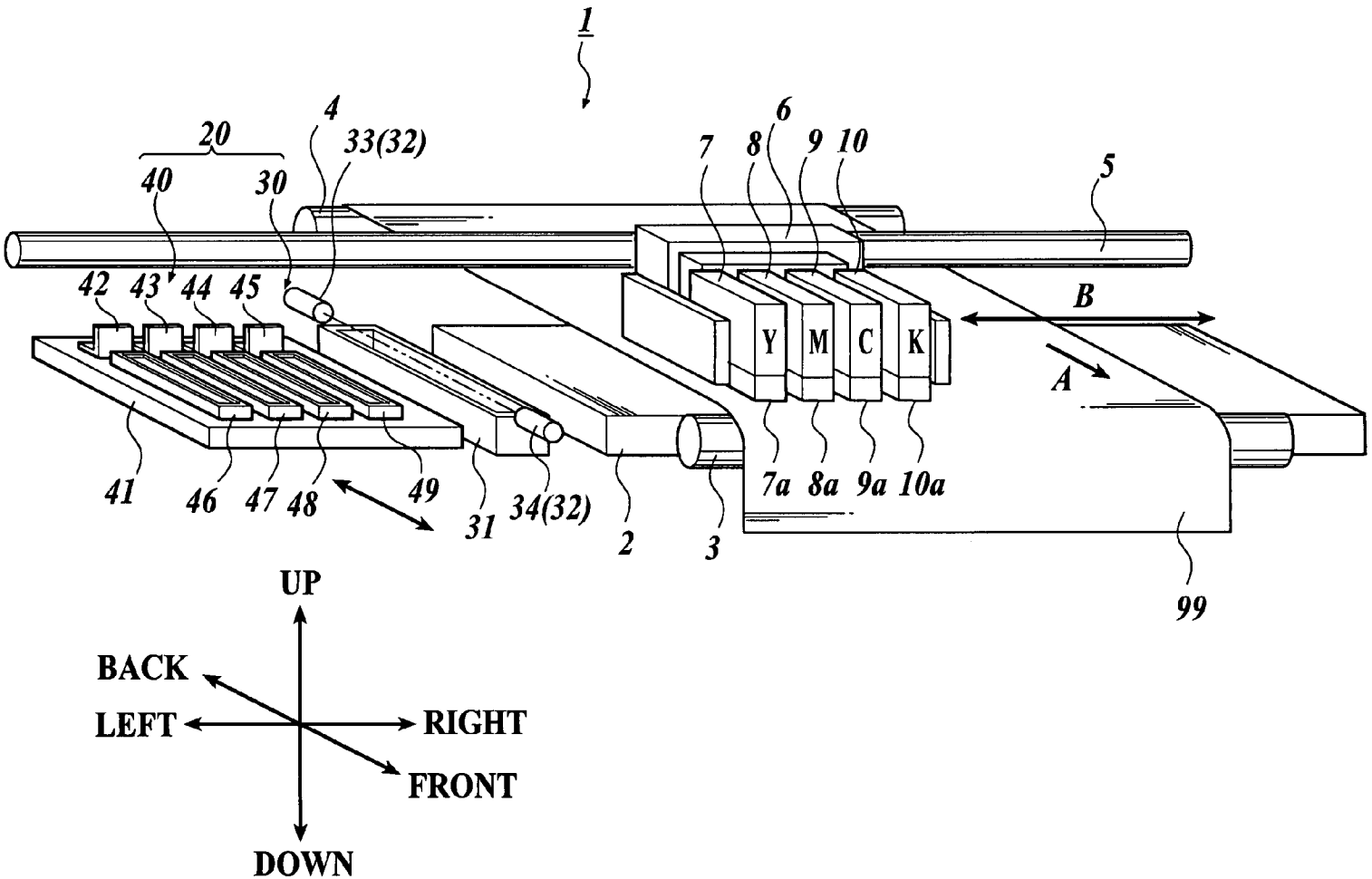
FIG. 2 is a perspective view showing an inkjet printer 1.
Figure 3:
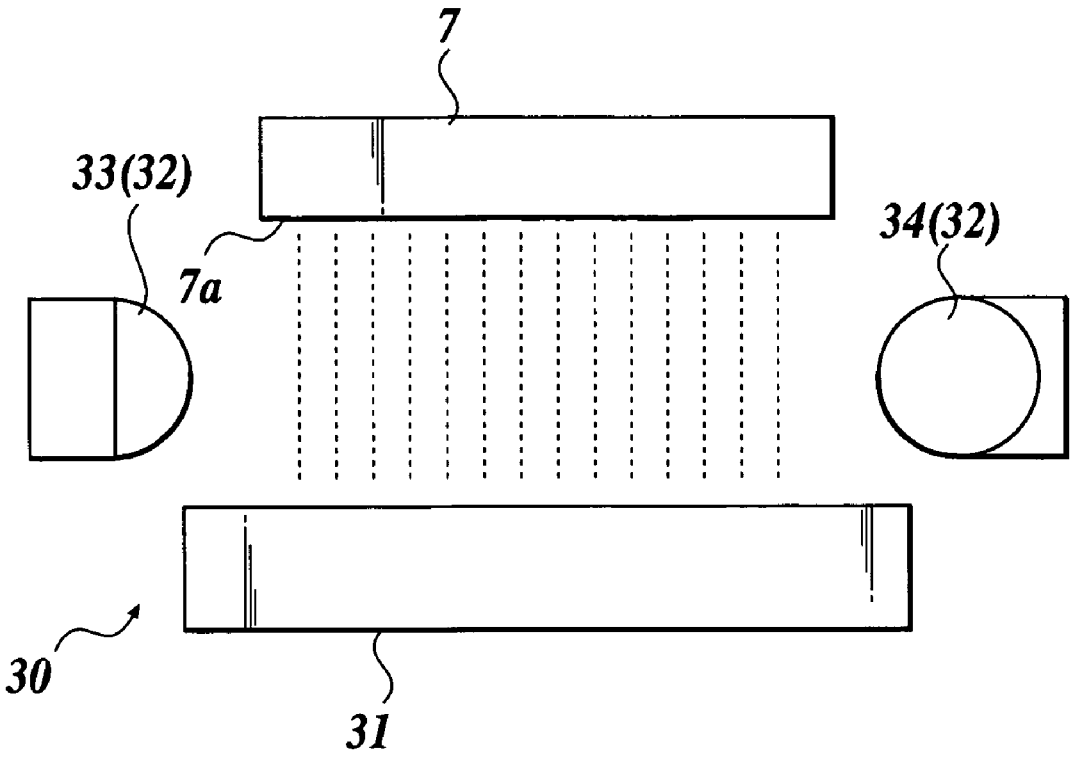
FIG. 3 is a side view showing a recording head 7, an ink receiving unit 31 and a jetting examination sensor 32.
Figure 4:
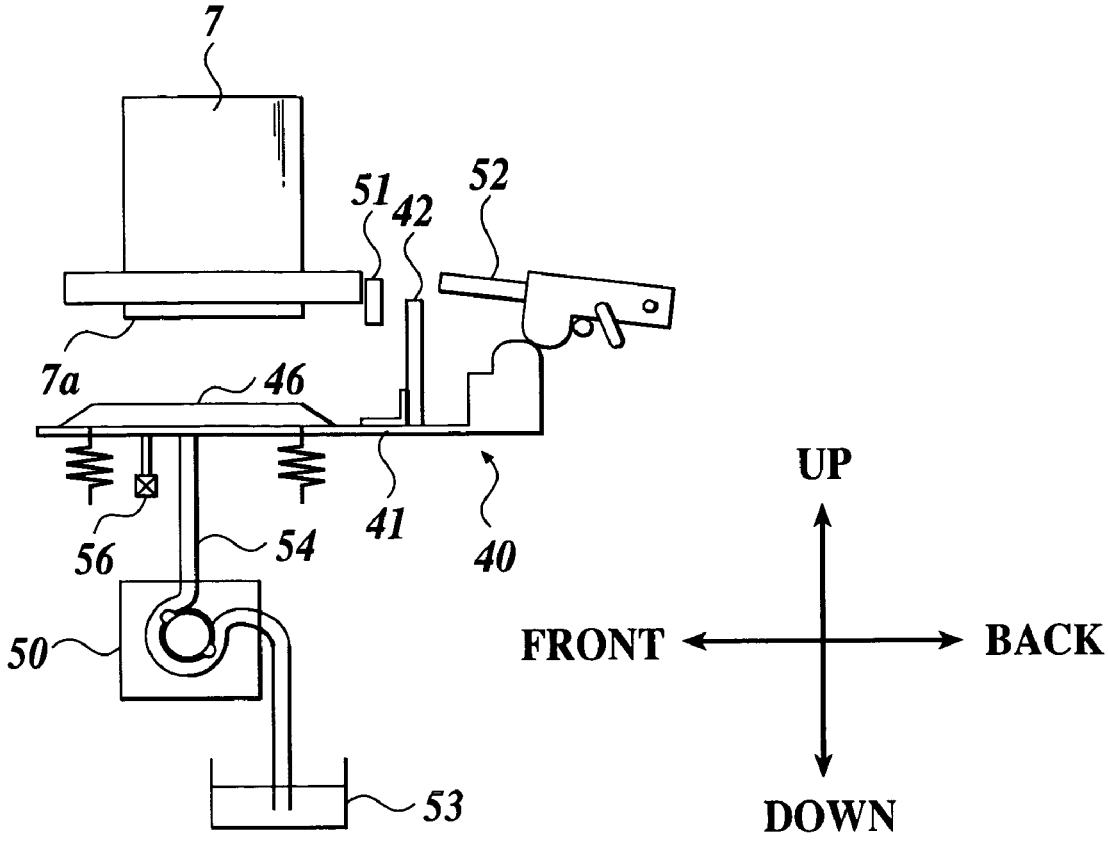
FIG. 4 is a side view of the recording head 7 and a cleaning unit 40.
Figure 5:
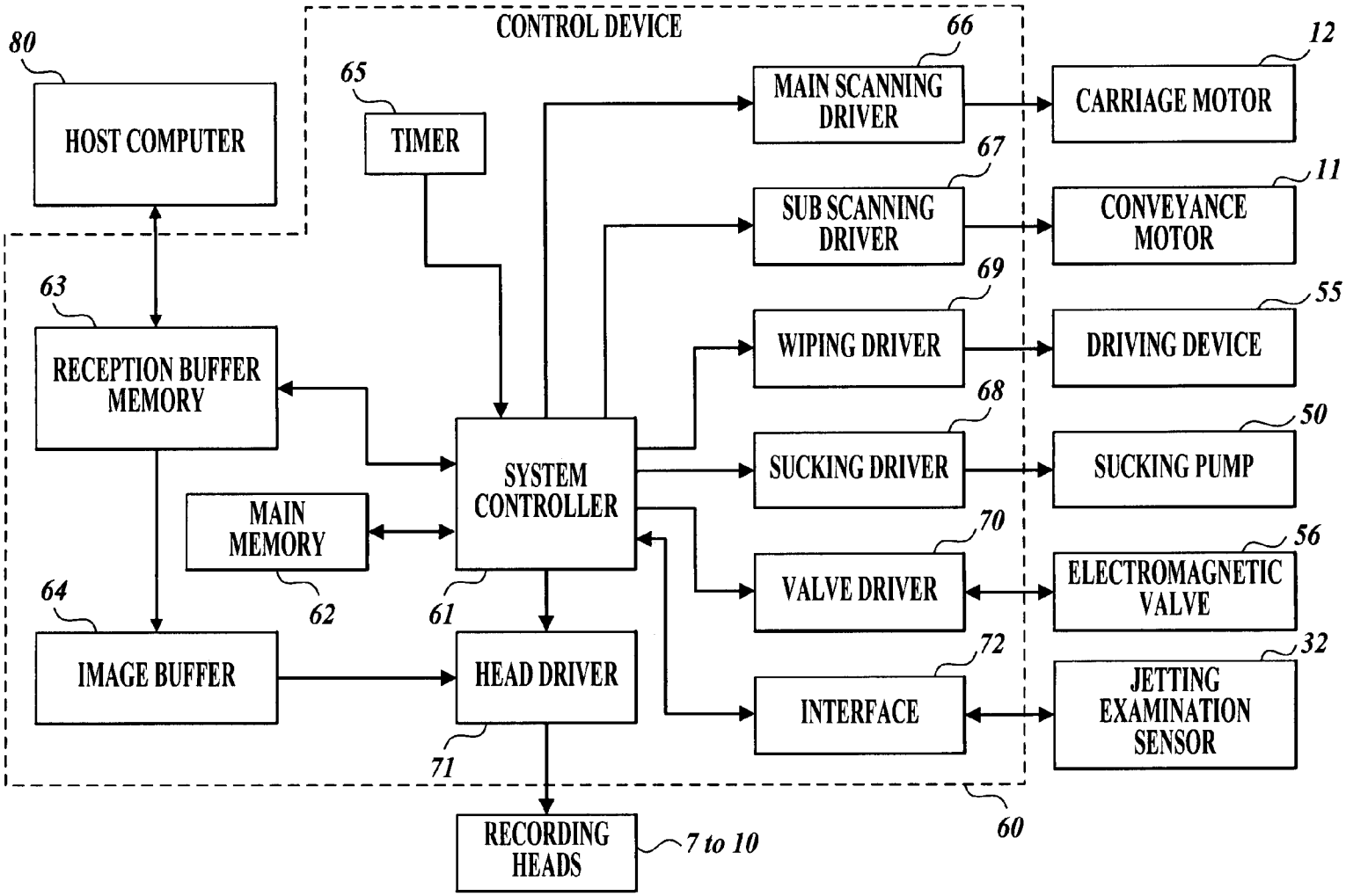
FIG. 5 is a block diagram showing a circuit structure of the inkjet printer 1.

FIG. 2 is a perspective view of an inkjet printer 1 to which the present invention is applied. FIG. 3 is a side view showing a recording head 7, an ink receiving unit 31 and a sucking examination sensor 32 each of which is provided in the inkjet printer 1. FIG. 4 is a side view showing the recording head 7 and a cleaning unit 40 provided in the inkjet printer 1. FIG. 5 is a block diagram showing a control device 60 provided in the inkjet printer 1.

As shown in FIG. 2, the inkjet printer 1 comprises a platen 2. The platen 2 is formed in a plate shape, and is used for supporting a recording medium 99 which has a sheet form, from underneath. Conveyance rollers 3 and 4 are respectively placed at the front and back of the platen 2, and the shaft center of the conveyance rollers 3 and 4 is placed in parallel with an upper surface of the platen 2. A conveyance motor 11 (see FIG. 5) is connected to the conveyance rollers 3 and 4 to be a driving force, so that when the conveyance motor 11 drives the conveyance rollers 3 and 4 to rotate around the shaft center, the recording medium 99 set to the conveyance rollers 3 and 4 is conveyed along a conveyance direction A. Here, the conveyance direction A is a direction being orthogonal to the shaft center of the conveyance roller 3 and 4.

In FIG. 2, a guide member 5 is placed above the platen 2. The guide member 5 is provided approximately in parallel with the upper surface of the platen 2, and further in orthogonal to the conveyance direction A. This longitudinal direction along which the guide member 5 is provided is a scanning direction B. The guide member 5 supports a carriage 6. A carriage motor 12 (see FIG. 5) drives the carriage 6 to move back and forth along the scanning direction B in a state of being guided by the guide member 5.

The carriage 6 comprises four recording heads 7 to 10 for jetting ink of each process colors of yellow (Y), magenta (M), cyan (C) and black (K) respectively, toward a recording surface of the recording medium 99. These recording heads 7 to 10 are arranged at even intervals along the scanning direction B. These recording heads 7 to 10 are moved with the carriage 6 back and forth along the scanning direction B.

A plurality of jet openings (illustration omitted) are formed on each of bottom surfaces 7*a* to 10*a* of the recording heads 7 to 10 (surfaces facing to the platen 2), so that each of the recording heads 7 to 10 jets ink as droplet from these jet openings. In other words, each of the bottom surfaces 7*a* to 10*a* of each of the recording heads 7 to 10 is an ink jetting surface. In each of the recording heads 7 to 10, jet openings of ink are arranged so as to make one line or a plurality of lines along the conveyance direction.

Here, four ink tanks for storing ink of each of the process colors of Y, M, C and K respectively are connected to each of the recording heads 7 to 10 through a flexible tube which is capable of following the back-and-forth movement of the carriage 6. Ink is supplied to the four recording heads 7 to 10 from each ink tank through the flexible tube with respect to each color.

Further, the inkjet printer 1 comprises a recovering unit 20 for recovering each of the recording heads 7 to 10 from jetting failure. The recovering unit 20 is placed below the recording heads 7 to 10 and the carriage 6, and at the left side of the platen 2.

The recovering unit 20 comprises an simulated jetting unit 30 which is placed at a location to perform simulated jetting, which jets ink without involving image recording, and a cleaning unit 40 for cleaning the recording heads 7 to 10. As shown in FIG. 2 and FIG. 3, the simulated jetting unit 30 comprises an ink receiving unit 31 for receiving ink which is jetted each of the recording heads 7 to 10 according to simulated jetting, and a jetting examination sensor 32 for examining whether ink is jetted from each jet opening on the bottom surfaces 7*a* to 10*a* of the recording heads 7 to 10.

The ink receiving unit 31 is provided in a rectangular solid box shape so as to have the upper surface opened, and is located next to the platen 2 to the left. Here, an ink receiving unit composed of spongy ink absorbing material may be placed instead of the box-like ink receiving unit 31, or the ink receiving unit 31 may incorporate therein spongy ink absorbing material.

In the proximity of the ink receiving unit 31, the jetting examination sensor 32 is placed. The jetting examination sensor 32 comprises a light emitting element 33 and a light receiving element 34. The light emitting element 33 is placed above the ink receiving unit 31 and below the bottom surfaces 7*a* to 10*a* of the recording heads 7 to 10, and further at an upstream side of the conveyance direction A with respect to the ink receiving unit 31 (that is, backside). The light emitting element 33 emits light linearly toward a downstream of the conveyance direction A (that is, frontside) along the conveyance direction A, and the light receiving element 34 is placed on the line of the emitted light from the light emitting element 33. Concretely, the light receiving element 34 is placed above the ink receiving unit 31, below the bottom surfaces 7*a* to 10*a* of the recording heads 7 to 10, and at a downstream side of the conveyance direction A with respect to the ink receiving unit 31. The light receiving element 34 receives light which has passed above the ink receiving unit 31 from the light emitting element 33, and outputs a normal detection signal to a control device 60 when the light from the light emitting element 33 is blocked.

As shown in FIG. 2 and FIG. 4, the cleaning unit 40 comprises a base member 41 which is placed next to the ink receiving unit 31 to the left, wiper blades 42 to 25 for wiping the bottom surfaces 7*a* to 10*a* of each of the recording heads 7 to 10, cap members 46 to 49 for sucking (drawing) ink from each of the recording heads 7 to 10, a sucking pump 50 for generating a sucking force of the cap members 46 to 49, a scraper 51 for eliminating ink adhering to the wiper blades 42 to 45, a cleaning blade 52 for sucking ink adhering to the wiper blades 42 to 45, a waste ink tank 53 for storing ink sucked by the sucking pump 50 through the cap members 46 to 49, and a driving device 55 (see FIG. 5) for moving the base member 41 vertically and for moving the base member 41 in front and back directions. Here, a unit comprising the cap members 46 to 49 and the sucking pump 50 is a sucking mechanism for sucking ink from each jet opening of each of the recording heads 7 to 10.

The base member 41 is moved by the driving device 55 along the front and back direction in FIG. 2, that is, the conveyance direction A. Further, the base member 41 is moved by the driving device 55 along up and down direction. Here, instead of moving the base member 41 vertically, the recording heads 7 to 10 may be provided so as to be moved vertically along with the carriage 6.

At the back edge part of the upper surface of the base member 41, four wiper blades 42 to 45 made of elastomeric material such as silicon rubber or the like are provided so as to stand up. These wiper blades 42 to 45 are arranged along the scanning direction B at even intervals that are the same as that of the recording heads 7 to 10. The number of provided wiper blades 42 to 45 is the same as that of the provided recording heads 7 to 10. Therefore, each one of the recording heads 7 to 10 corresponds to each one of the wiper blades 42 to 45.

On the upper surface of the base member 41, the cap members 46 to 49 are provided. Each of the cap members 46 to 49 is placed at the front of each of the wiper blades 42 to 45. The number of the provided cap members 46 to 49 is the same as that of the recording heads 42 to 45. Therefore, each one of the recording heads 7 to 10 corresponds to each one of the cap members 46 to 49.

The sucking pump 50 is provided to each of the four cap members 46 to 49. Here, description will be made in regard to the sucking pump 50 corresponding to the cap member 46. The sucking pump 50 is placed below the base member 41, and the waste ink tank 53 for storing ink to be dumped is placed below the sucking pump 50. Between the base member 41 and the waste ink tank 53, a tube 54 made of rubber is placed. One edge of the tube 54 is communicated with the cap member 46 through the base member 41, and another edge of the tube 54 is communicated with the waste ink tank 53. In the middle of the tube 54, the sucking pump 50 that employs a tube system is placed. The sucking pump 50 generates a sucking force within the cap member 46 through the tube 54 by making space within the tube 54 in a pressure-reduced state. In detail, the sucking pump 50 comprises a motor 90, and a shaft center portion 91 of the motor 90 comprises two roller members 92 and 92. A case 93 of the motor 90 comprises three projections 94, 94 and 94, and the tube 54 is pinched between the shaft center portion 91 and each projection 94. When the motor 90 functions to be rotated, the sucking pump 50 generates a sucking force within the cap member 46 through the tube 54 with each roller member 92 grinding the tube 54.

Below the cap member 46, an electromagnetic valve 56 for freeing a sucking force within the cap member 46 is provided. In a state where a sucking force is generated within the cap member 46, when the electromagnetic valve is freed, pressure within the cap member 46 is increased back to atmosphere pressure.

Here, description has been made in regard to the sucking pump 50 and the electromagnetic valve 56 involved with the cap member 46, which is one among the four cap members 46 to 49. However, such sucking pump 50 and electromagnetic valve 56 correspond to each of the four cap members 46 to 49 and are provided with each of the cap members 46 to 49. Further, within each of the cap members 46 to 49, it is possible to suitably change a sucking force in correspondence with an operation condition of the sucking pump 50.

Above the base member 41, the scraper 51 is placed. With the wiper blades 42 to 45 moved in the front direction so as to follow the base member 41, the scraper 51 scrapes with the surfaces of the wiper blades 42 to 45.

Behind the scraper 51, the cleaning blade 52 is placed. With the wiper blades 42 to 45 moved in the back direction so as to follow the base member 41, the cleaning blade 52 is contacted with the wiper blades 42 to 45. When the cleaning blade 52 is contacted with the wiper blades 42 to 45, ink adhering to the surfaces of the wiper blades 42 to 45 is absorbed in the cleaning blade 52.

As shown in FIG. 5, the inkjet printer 1 comprises a conveyance motor 11, a carriage motor 12, a jetting examination sensor 32, and a control device 60 which controls the sucking pump 50 and the driving device 55.

The control device 60 comprises a system controller 61, a main memory 62 which provides an operation area of the system controller 61, a reception buffer memory 63 for temporarily storing data in order to transmit/receive image data or the like to/from a host computer 80, an image buffer 64 for temporarily storing the image data received from the host computer 80, a timer 65 for performing measurement according to a clock signal, a main scanning driver 66 for driving and controlling the carriage motor 12, a sub scanning driver 67 for driving and controlling the conveyance motor 11, a sucking driver 68 for driving and controlling the sucking pump 50, a wiping driver 69 for driving and controlling the driving device 55, a valve driver for driving and controlling the electromagnetic valve 56, a head driver 71 for driving the recording heads 7 to 10 according to the image data stored in the image buffer 64, and an interface 72 for inputting a detection signal from the jetting examination sensor 32.

The control device 60 controls the carriage motor. 12, the conveyance motor 11, the sucking pump 50, the electromagnetic valve 56, and the recording heads 7 to 10 through each of the drivers 66 to 71 by data-processing at the system controller 61 by using the main memory 62 as an operation area. When a normal detection signal is inputted from the jetting examination sensor 32 (light receiving 34) through the interface 72, the control device 60 detects normality of jet openings of the recording heads 7 to 10. On the contrary, when a normal detection signal is not inputted from the jetting examination sensor 32 (light receiving element 34) through the interface 72, the control device 60 detects jetting failure of jet openings of the recording heads 7 to 10. Further, the control device 60 performs counting according to the data processing of the system controller 61. Counted number which is counted by the system controller 61 is stored in the main memory 62. Further, the control device 60 compares the counted number with predetermined number M, predetermined count I, predetermined count J, predetermined number K1, predetermined count K2 and the like. Further, the control device 60 performs measurement with the timer 65.

Further, a start input button is connected to the control device 60. When a user pushes the start input button, a cleaning start signal is inputted to the control device 60 from the start input button.

Next, an operation and effect of the inkjet printer 1 will be described.

[1. Image Recording Operation]

When the control device 60 receives image data (image recording start signal) from the host computer 80, the control device outputs a control signal to the conveyance motor 11, the carriage motor 12, the recording heads 7 to 10 and the like, for controlling operations of each structure in the following way. That is, with the control device 60 repeating the starting and stopping of the conveyance motor 11, each of the conveyance rollers 3 and 4 repeats rotation as much as predetermined amount and stoppage thereof, whereby the recording medium 99 is moved along the conveyance direction A intermittently.

While the movement of the recording medium 99 is temporarily being stopped in this state, when the control device 60 actuates the carriage motor 12, the carriage 6 is moved along with each of the recording heads 7 to 10 right above the recording medium 99 from left to right (or from right to left) in FIG. 2 along the scanning direction B. Then, while the carriage 6 is moving, when the control device 60 makes each of the recording heads 7 to 10 perform a jetting operation suitably according to image data, ink is jetted as minute droplet toward the recording surface of the recording medium 99 from jet openings on the bottom surfaces 7*a* to 10*a* of each of the recording heads 7 to 10.

Thereafter, with each component of the inkjet printer 1 repeating the above-described operation, images are sequentially recorded on an image recording area of the recording surface of the recording medium passing over the platen 2.

[2. Recovering Operation]

Here, in addition to the above-described image recording operation, the inkjet printer 1 performs a recovering operation which recovers the recording heads 7 to 10 from jetting failure. There are nine types of recovering operations of the inkjet printer 1. Hereinafter, the nine types of recovering operations will sequentially be described. Here, the jetting failure means that ink is not jetted from a jet opening even though the recording heads 7 to 10 performs an ink jetting operation.

[2-1. First Recovering Operation]

Figure 6:
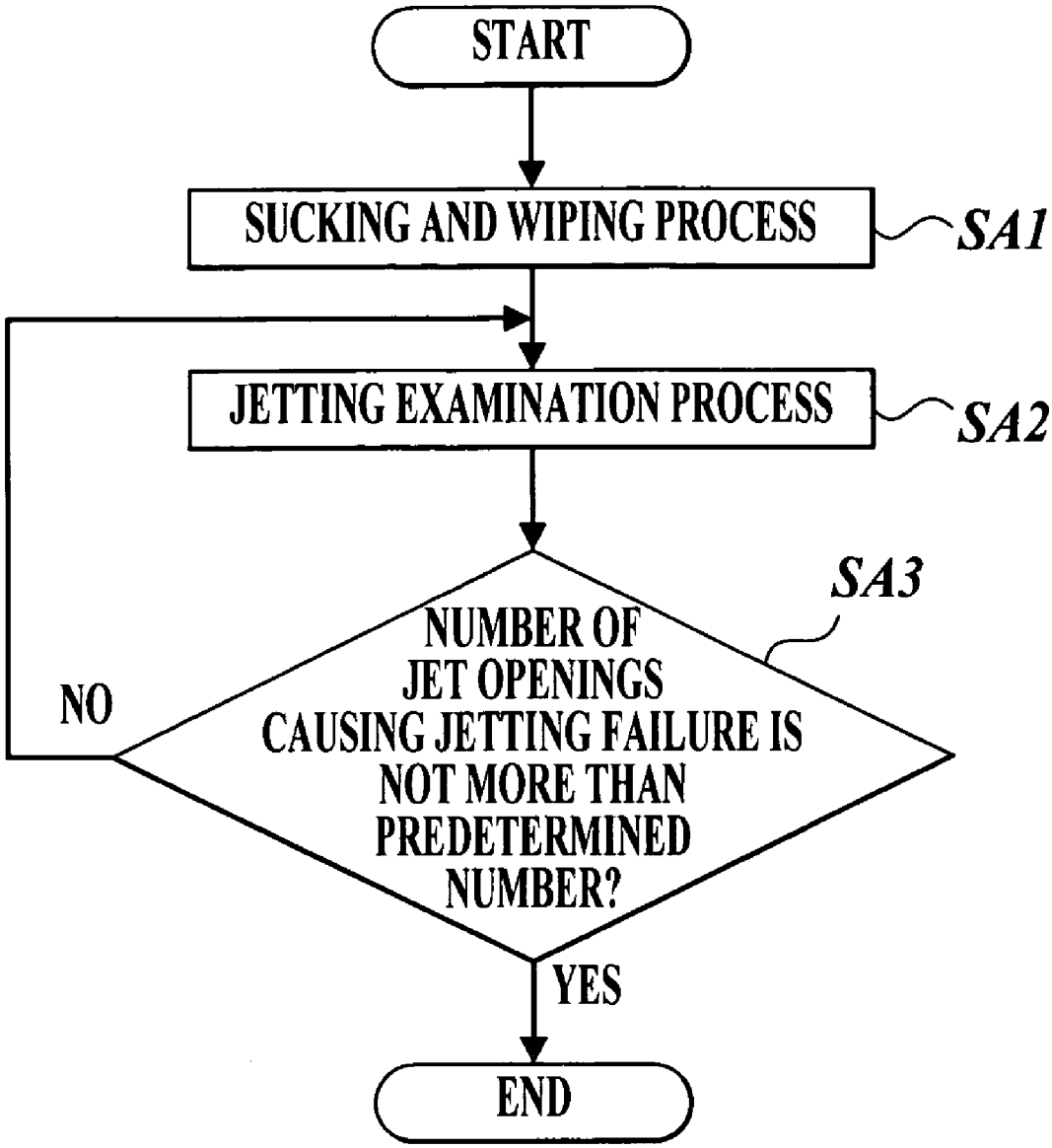
FIG. 6 is a flowchart illustrating a flow of a process of a control device 60 when the inkjet printer performs a first recovering operation.

A first recovering operation among the nine types of recovering operations will be described with reference to FIG. 6. FIG. 6 is a flowchart illustrating a first recovering processing mode by the control device 60 at the first recovering operation, with time.

[Step SA1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The sucking and wiping operation is performed in the following way.

That is, when the control device 60 actuates the carriage motor 12, the carriage 6 is moved to above the base member 41 so as to locate the recording heads 7 to 10 above the cap members 46 to 49, respectively. Next, when the control device 60 actuates the driving device 55, the base member 41 is moved up so as to contact the cap members 46 to 49 with the bottom surfaces 7*a* to 10*a* of the recording heads 7 to 10, respectively.

After the cap members 46 to 49 respectively get contacted with the bottom surfaces 7*a* to 10*a*, when the control device 60 actuates the sucking pump 50, pressure within the cap members 46 to 49 is reduced, whereby ink is sucked from each jet opening of the recording heads 7 to 10. After predetermined period passes in this state, when the control device 60 stops the sucking pump 50 and opens the electromagnetic valve 56, pressure within the cap members 46 to 49 becomes atmosphere pressure.

Next, when the control device 60 actuates the driving device 55, the base member 41 moved down to the former height, and the base member 41 moves from back to front. At this time, upper parts of the wiper blades 42 to 45 move so as to respectively wipe the bottom surfaces 7*a* to 10*a* of the recording heads 7 to 10, whereby ink adhering to the bottom surfaces 7*a* to 10*a* is eliminated. Thereafter, when the driving device 55 moves the base member 41 from front to back, the wiper blades 42 to 45 get contacted with the cleaning blade 52. Thereby, ink adhering to the wiper blades 42 to 45 is absorbed by the cleaning blade 52. Here, since the scraper 51 scrapes the wiper blades 42 to 45 before the wiper blades 42 to 45 respectively get contacted with the recording heads 7 to 10, ink adhering to the wiper blades 42 to 45 is eliminated.

[Step SA2: Jetting Examination Process]

When the sucking and wiping process of Step SA1 is completed, the control device 60 makes the jetting examination sensor 32 examine whether there is any jet opening causing jetting failure among all the jet openings of the recording heads 7 to 10, for counting the number of jet openings causing jetting failure. Concretely, a process for counting the number of jet openings causing jetting failure is performed in the following way.

That is, when the control device 60 actuates the carriage motor 12, the carriage 6 is moved so as to locate the recording head 7 above the ink receiving unit 31. When the recording head 7 is located above the ink receiving unit 31, the control device 60 makes all the jet openings of the recording head 7 perform the simulated jetting. In this case, the control device 60 makes a plurality of jet openings forming a line jet ink for the simulated jetting, by one jet opening at a time from one edge to another edge. Further, the similar operation is performed on each line.

If ink is normally jetted from a jet opening, since light emitted from the light emitting element 33 is temporarily blocked by the ink and received by the light receiving element 34, the light receiving element.34 outputs a normal detection signal to the control device 60. When the light receiving element 34 of the jetting examination sensor 32 inputs the detection signal at the time that a jet opening performs the simulated jetting, the control device 60 detects that the jet opening is able to normally jet ink. On the other hand, when ink is not jetted from a jet opening because of the fact that light emitted from the light emitting element 34 is directly received by the light receiving element 34 without being blocked, the light receiving element 34 does not output a normal detection signal to the control device 60. When the light receiving element 34 does not input the normal detection signal at the time that the jet opening performs the simulated jetting, the control device 60 detects that the jet opening is not able to jet ink and count-up is performed.

When all the jet openings of the recording head 7 are examined in regard to jetting failure, the control device 60 counts the number of jet openings causing jetting failure with respect to each of the recording heads 8 to 10, as well as the case of the recording head 7. The control device 60 stores the counted number of jet openings causing jetting failure in the main memory. Here, the sum total of the number of jet openings causing jetting failure with respect to the recording heads 7 to 10 may be stored in the main memory, or the number of jet openings causing jetting failure with respect to each of the recording heads 7 to 10 may be stored in the main memory.

[Step SA3: Comparing Process]

Next, the control device 60 compares the number of jet openings causing jetting failure counted in the Step SA2 (sum total of the number of jet openings causing jetting failure with respect to the recording heads 7 to 10) with the predetermined number M. Here, the predetermined number M is more than zero and less than the sum total of the number of all the jet openings of the recording heads 7 to 10. For example, if the number of all the jet openings of the recording heads 7 to 10 is 2048, the predetermined number M is set to 20. If the control device 60 judges the number of jet openings causing jetting failure is not more than the predetermined number M according to the comparison result, the process of the control device 60 is finished and the recovering operation of the inkjet printer 1 is completed. On the other hand, if the control device 60 judges that the number of jet openings causing jetting failure is more than the predetermined number M according to the comparison result, the process of the control device 60 returns to Step SA2, and the control device 60 performs the process of Step SA2 again. Therefore, until the number of jet openings causing jetting failure becomes not more than the predetermined number M, the control device 60 repeats the processes in the order of Step SA2 and Step SA3. Since it is possible to reduce the number of jet openings causing jetting failure as the predetermined number M becomes smaller, it is possible to record a better image. Here, if the number of jet openings causing jetting failure with respect to each of the recording heads 7 to 10 is stored in the main memory, the number of jet openings causing jetting failure with respect to each of the recording heads 7 to 10 may be compared with a predetermined number M' in Step SA3. In this case, the predetermined number M' is more than zero and less than the number of jet openings of each of the recording heads 7 to 10. For example, if the number of jet openings of the recording head 7 is 512, the predetermined number M' is set to 4.

Here, after the completion of the above-described first recovering operation, when the host computer 80 inputs image data to the control device 60, the inkjet printer 1 performs the above-described [1. image recording operation].

As mentioned, in the first recovering operation, after the sucking and wiping process of Step SA1 is performed, the examination process of SA2, which counts the number of jet openings causing jetting failure, is performed, wherein, when the number of jet openings causing jetting failure is more than the predetermined number M, what is performed is not the sucking process again but the examination process repeatedly. Therefore, while the examination process is being repeated, the number of jet openings causing jetting failure is reduced. Then, when the number of jet openings causing jetting failure becomes not more than the predetermined number M, the operation of the inkjet printer 1 is transferred to the image recording operation. Therefore, it is possible to minimize the time to transfer the operation to the image recording operation, and further, it is possible to prevent missing dot in a recording image, whereby it is possible to suppress image deterioration.

[2-2. Second Recovering Operation]

Figure 7:
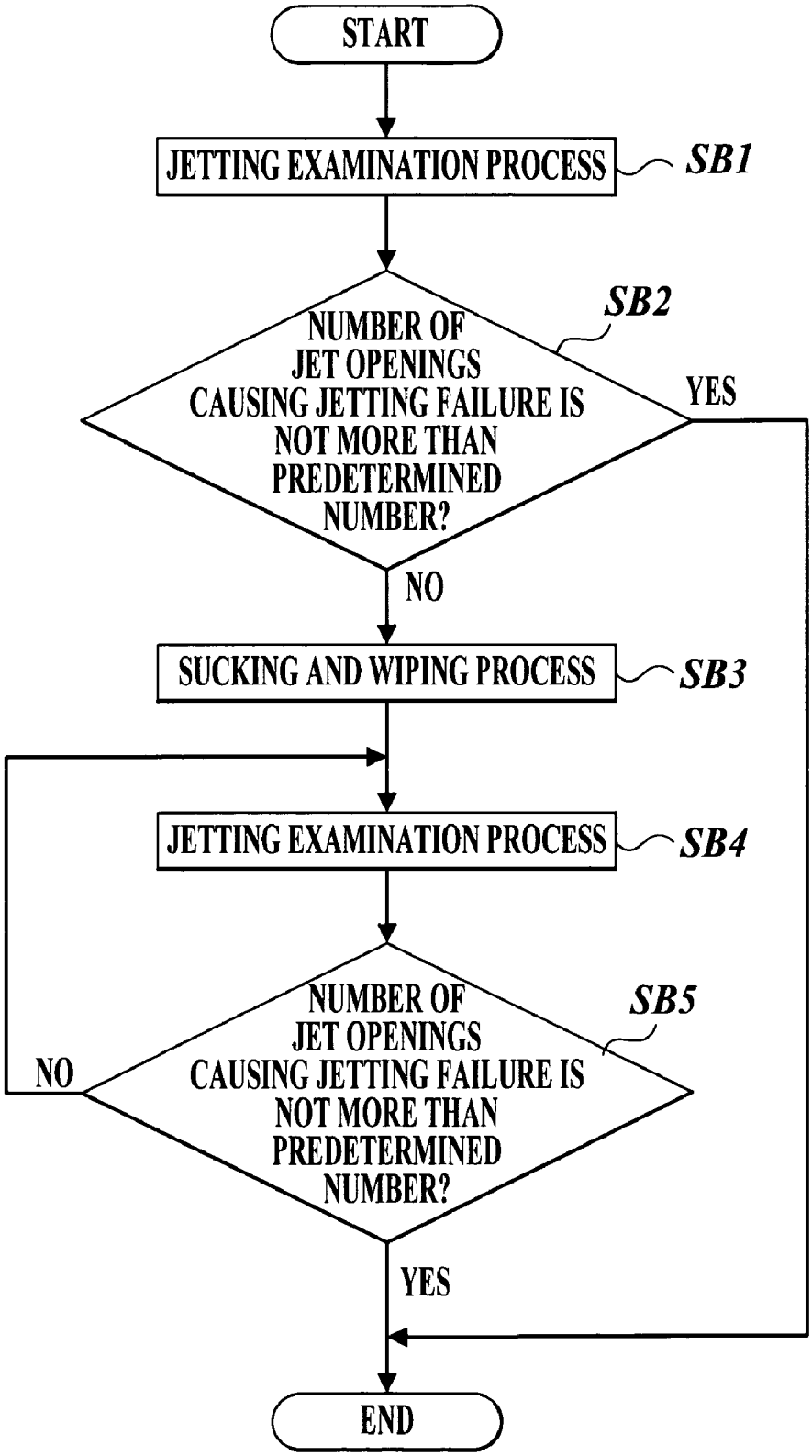
FIG. 7 is a flowchart illustrating a flow of a process of the control device 60 when the inkjet printer performs a second recovering operation.

A second recovering operation among the nine types of recovering operations will be described with reference to FIG. 7. FIG. 7 is a flowchart illustrating a second processing mode performed by the control device 60 at the second recovering operation, with time.

[Step SB1: Jetting Examination Process]

The control device 60 examines whether there is any jet opening causing jetting failure among all the jet openings of the recording heads and counts the number of jet openings causing jetting failure, at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SB1 is the same as the process in Step SA2 of the first recovering processing mode.

[Step SB2: Comparing Process]

Next, the control device 60 compares the number of jet openings causing jetting failure counted in Step SB1 with predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number according to the comparison result, the process of the control device 60 is transferred to Step SB3.

[Step SB3: Sucking and Wiping Process]

In Step SB3, the control device 60 performs the sucking and wiping process of the recording heads 7 to 10. The process of the control device 60 in Step SB3 is the same as the process in Step SA1 of the first recovering processing mode.

[Step SB4: Jetting Examination Process]

Following Step SB3, the control device 60 counts the number of jet openings causing jetting failure among all the jet openings of the recording heads 7 to 10. The process of the control device 60 in Step SB3 is the same as the process in Step SA2 of the first recovering processing mode.

[Step SB5: Comparing Process]

Following Step SB4, the control device 60 compares the number of jet openings causing jetting failure counted in Step SB 4 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the process of the control device 60 returns to Step SB4, and the control device 60 performs the process of Step SB4 again. Therefore, until the number of jet openings causing jetting failure becomes not more than the predetermined number M, the control device 60 repeats the process of Step SB4.

Here, after the completion of the above-described second recovering operation, when the host computer 80 inputs image data to the control device 60, the inkjet printer 1 performs the above-described [1. image recording operation].

As mentioned, also in the second recovering operation, after the sucking and wiping process in Step SB3 is performed, the examination process in Step SB4, which counts the number of jet openings causing jetting failure, is performed, wherein, when the number of jet openings causing jetting failure is more than the predetermined number M, what is performed is not the sucking process again, but the examination process repeatedly. Therefore, while the examination process is being repeated, the number of jet openings causing jetting failure is reduced. Then, when the number of jet openings causing jetting failure becomes not more than the predetermined number M, the operation of the inkjet printer 1 is transferred to the image recording operation. Thereby, it is possible to prevent missing dot in a recording image, whereby it is possible to suppress image deterioration.

Meanwhile, the control device 60 performs the sucking and wiping process of Step SB1 before the sucking and wiping process of Step SB3, and according to the examination result, if the number of jet openings causing jetting failure is not more than the predetermined number M, the control device 60 does not perform the sucking and wiping process of Step SB3. Therefore, it is possible to prevent jetting failure from being caused by the sucking and wiping process of Step SB3, and further, it is possible to minimize the operation time.

[2-3. Third Recovering Operation]

Figure 8:
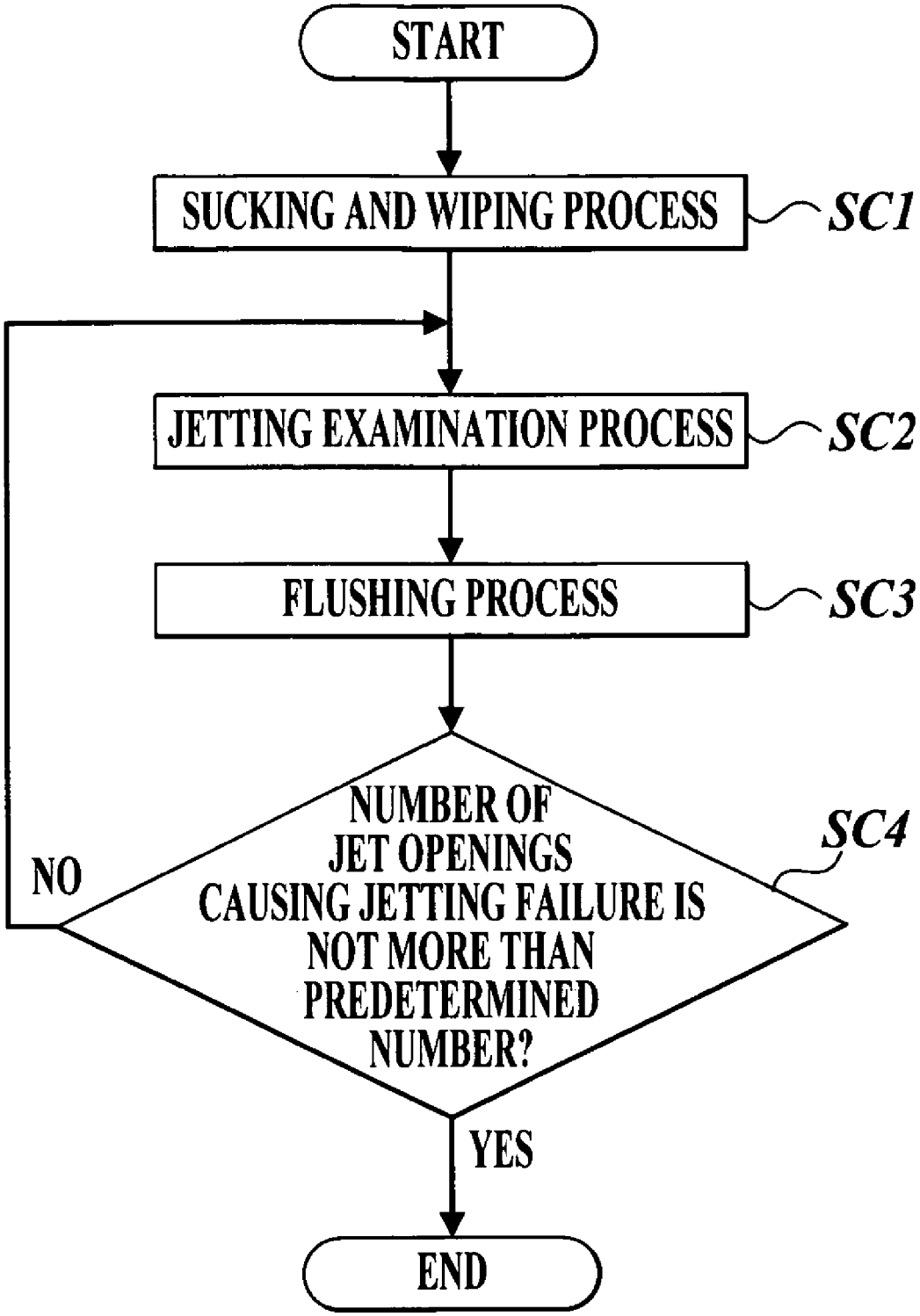
FIG. 8 is a flowchart illustrating a flow of a process of the control device 60 when the inkjet printer performs a third recovering operation.

A third recovering operation among the nine types of recovering operations will be described with reference to FIG. 8. FIG. 8 is a flowchart illustrating a third recovering processing mode performed by the control device 60 at the third recovering operation, with time.

[Step SC1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SC1 is the same as the process in Step SA1 of the first recovering processing mode.

[Step SC2: Jetting Examination Process]

Following Step SC1, the control device 60 counts the number of jet openings causing jetting failure of the recording heads 7 to 10. The process of the control device 60 in Step SC2 is the same as the process in Step SA2 of the first recovering processing mode.

[Step SC3: Flushing Process]

Following Step SC2, the control device 60 performs a flushing process (simulated jetting process) of the recording heads 7 to 10. Concretely, when the control device 60 actuates the carriage motor 12, the carriage 6 is moved so as to locate the recording head 7 above the ink receiving unit 31. When the recording head 7 is located above the ink receiving unit 31, the control device 60 makes all the jet openings of the recording head 7 perform the simulated jetting. Here, the control device 60 may make all the jet openings of the recording head 7 perform the simulated jetting simultaneously, or may make the jet openings of the recording head 7 perform the simulated jetting in predetermined order. When the simulated jetting of all the jet openings of the recording head 7 is completed, the control device makes the carriage motor 12 move so as to locate the recording heads 8 to 10 also above the ink receiving unit 31 sequentially. Then, when the recording heads 8 to 10 are respectively located above the ink receiving unit 31, the control device 60 makes all the jet openings of each of the recording heads 8 to 10 jet ink to perform the simulated jetting. Since the flushing process in SC3 performs the simulated jetting from each jet opening of the recording heads 7 to 10 after the sucking and wiping process in Step SC2, it is possible to promote recovering a jet opening from jetting failure to a state to be able to jet ink.

Here, in the flushing process of Step SC3, a position where the recording heads 7 to 10 perform the simulated jetting is the same as where the recording heads 7 to 10 perform the simulated jetting in the jetting examination process of Step SC2.

[Step SC4: Comparing Process]

Following Step SC3, the control device 60 compares the number of jet openings causing jetting failure counted in Step SC2 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the process of the control device 60 returns to Step SC2, and the control device 60 performs the process of Step SC2 again. Therefore, until the number of jet openings causing jetting failure becomes not more than the predetermined number M, the control device 60 repeats the processes of Step SC2 and Step SC3.

Here, if the control device 60 judges that the number of jet openings causing jetting failure is more than the predetermined number M in the process of Step SC4, the process of the control device 60 may return to Step SC3, and until the number of jet openings causing jetting failure becomes not more than the predetermined number M, the control device 60 may repeat the process of SC3.

After the completion of the above-described third recovering operation, when the host computer 80 inputs image data to the control device 60, the inkjet printer 1 performs the above-described [1. image recording operation].

[2-4. Fourth Recovering Operation]

Figure 9:
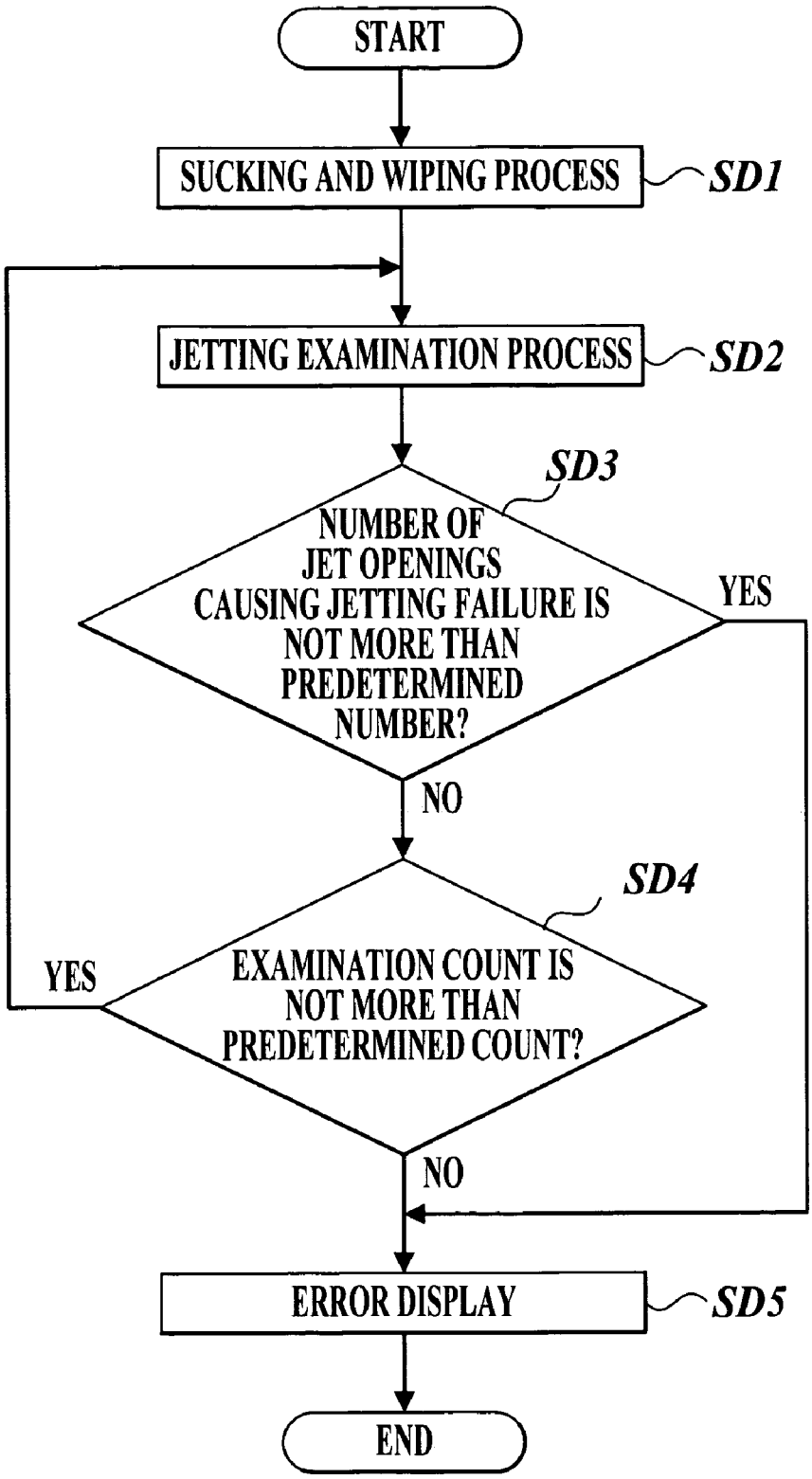
FIG. 9 is a flowchart illustrating a flow of a process of the control device 60 when the inkjet printer performs a fourth recovering operation.

A fourth recovering operation among the nine types of recovering operations will be described with reference to FIG. 9. FIG. 9 is a flowchart illustrating a fourth recovering processing mode performed by the control device 60 at the fourth recovering operation, with time.

[Step SD1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SD1 is the same as the process in Step SA1 of the first recovering processing mode.

[Step SD2: Jetting Examination Process]

Following Step SD1, the control device 60 counts the number of jet openings causing jetting failure of the recording heads 7 to 10. The process of the control device 60 in Step SD2 is the same as the process in Step SA2 of the first recovering processing mode.

[Step SD3: Comparing Process]

Following Step SD2, the control device 60 compares the number of jet openings causing jetting failure counted in Step SD2 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the control device 60 counts up the examination count, and the process of the control device 60 is transferred to Step SD4. Here, after Step SD3, when the process of the control device 60 is completed and when the host computer 80 inputs image data to the control device 60, the inkjet printer 1 performs the above-described [1. image recording operation].

[Step SD4: Examination Count Comparing Process]

In Step SD4, the control device 60 compares the examination count which is counted up in Step SD3 with predetermined count I. If the control device 60 judges that the examination count is not more than the predetermined count I according to the comparison result, the process of the control device 60 returns to Step SD2, and the control device 60 performs the process of Step SD2 again. Therefore, until the examination count exceeds the predetermined count I, the control device 60 performs the processes of Step SD2 and Step SD3. On the other hand, if the examination count exceeds the predetermined count I by repeating Step SD2 and Step SD3, the process of the control device 60 is transferred to Step SD5. Here, while the control device 60 is repeating the processes of Step SD2 and SD3, if the number of jet openings causing jetting failure is not more than the predetermined number M (Step SD3; Yes), the process of the control device 60 is finished, and the recovering operation of the inkjet printer 1 is completed.

[Step SD5: Error Process]

In Step SD5, the control device 60 transmits an error signal to the host computer 80, and the host computer 80 performs an error display. Then, the process of the control device 60 is finished. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

As mentioned, also in the fourth recovering operation, after the sucking and wiping process of Step SD1 is performed, the jetting examination process of Step SD2, which counts the number of jet openings causing jetting failure, is performed, wherein the jetting examination process is repeatedly performed when the number of jet openings causing jetting failure is more than the predetermined number M. Therefore, while the jetting examination process is being repeated, the number of jet openings causing jetting failure is reduced. Further, with the error display performed in Step SD5, it is possible to notify a user or the like of the necessity of maintenance of the recording heads 7 to 10.

[2-5. Fifth Recovering Operation]

Figure 10:
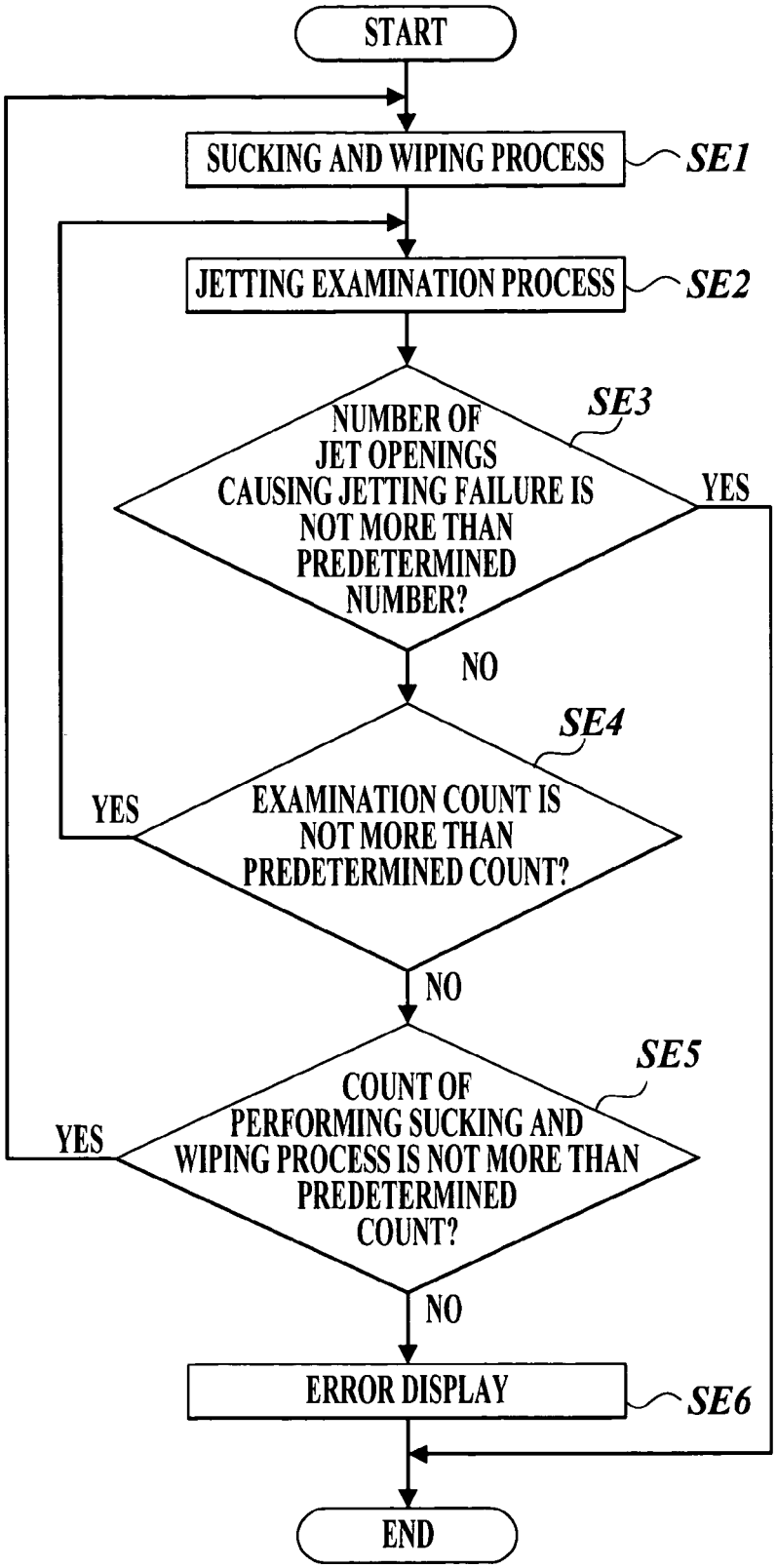
FIG. 10 is a flowchart illustrating a flow of a process of the control device 60 when the inkjet printer performs a fifth recovering operation.

A fifth recovering operation among the nine types of recovering operations will be described with reference to FIG. 10. FIG. 10 is a flowchart illustrating a fifth recovering processing mode performed by the control device 60 at the fifth recovering operation, with time.

[Step SE1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SE1 is the same as the process in Step SA1 of the first recovering processing mode. However, in Step SE1, after performing the sucking and wiping process, the control device 60 counts up the count of performing the sucking and wiping process.

[Step SE2: Jetting Examination Process]

Following Step SE1, the control device 60 counts the number of jet openings causing jetting failure of the recording heads 7 to 10. The process of the control device 60 in Step SE2 is the same as the process in Step SA2 of the first recovering processing mode.

[Step SE3: Comparing Process]

Following Step SE2, the control device 60 compares the number of jet openings causing jetting failure counted in Step SE2 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the control device 60 counts up the examination count, and the process of the control device 60 is transferred to Step SE4. Here, after Step SE3, when the process of the control device 60 is completed and when the host computer 80 inputs image data to the control device 60, the inkjet printer 1 performs the above-described [1. image recording operation].

[Step SE4: Examination Count Comparing Process]

In Step SE4, the control device 60 compares the examination count which is counted up in Step SE3 with predetermined count I. If the control device 60 judges that the examination count is not more than the predetermined count I according to the comparison result, the process of the control device 60 returns to Step SE2, and the control device 60 performs the process of Step SE2 again. Therefore, until the examination count exceeds the predetermined count I, the control device 60 repeats the processes of Step SE2 and Step SE3. On the other hand, if the examination count exceeds the predetermined count I by repeating Step SE2 and Step SE3, the process of the control device 60 is transferred to Step SE5. Here, while the control device 60 is repeating the processes of Step SE2 and SE3, if the number of jet openings causing jetting failure is not more than the predetermined number M (Step SE3; Yes), the process of the control device 60 is finished, and the recovering operation of the inkjet printer 1 is completed.

[Step SE5: Sucking and Wiping Process Count Comparing Process]

In Step SE5, the control device 60 compares the count of the sucking and wiping process counted up in Step SE1 with predetermined count J. If the control device 60 judges that the count of performing the sucking and wiping process is not more than the predetermined count J according to the comparison result, the process of the control device 60 returns to Step SE1, and the control device 60 performs the process of Step SE1 again. Therefore, until the count of performing the sucking and wiping process exceeds the predetermined count J, the control device 60 repeats the processes from Step SE1 to Step SE4. On the other hand, if the count of performing the sucking and wiping process exceeds the predetermined count J by repeating from Step SE1 to Step SE4, the process of the control device 60 is transferred to Step SE6.

[Step SE6: Error Process]

In Step SE6, the control device 60 transmits an error signal to the host computer 80, and the host computer 80 performs an error display. Then, the process of the control device 60 is finished. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

As mentioned, also in the fifth recovering operation, after the sucking and wiping process of Step SE1 is performed, the jetting examination process of Step SE2, which counts the number of jet openings causing jetting failure, is performed, wherein the jetting examination process is repeatedly performed when the number of jet openings causing jetting failure is more than the predetermined number M. Therefore, while the jetting examination process is being repeated, the number of jet openings causing jetting failure is reduced. Further, with the error display performed in Step SE5, it is possible to notify a user or the like of the necessity of maintenance of the recording heads 7 to 10.

[2-6. Sixth Recovering Operation]

Figure 11:
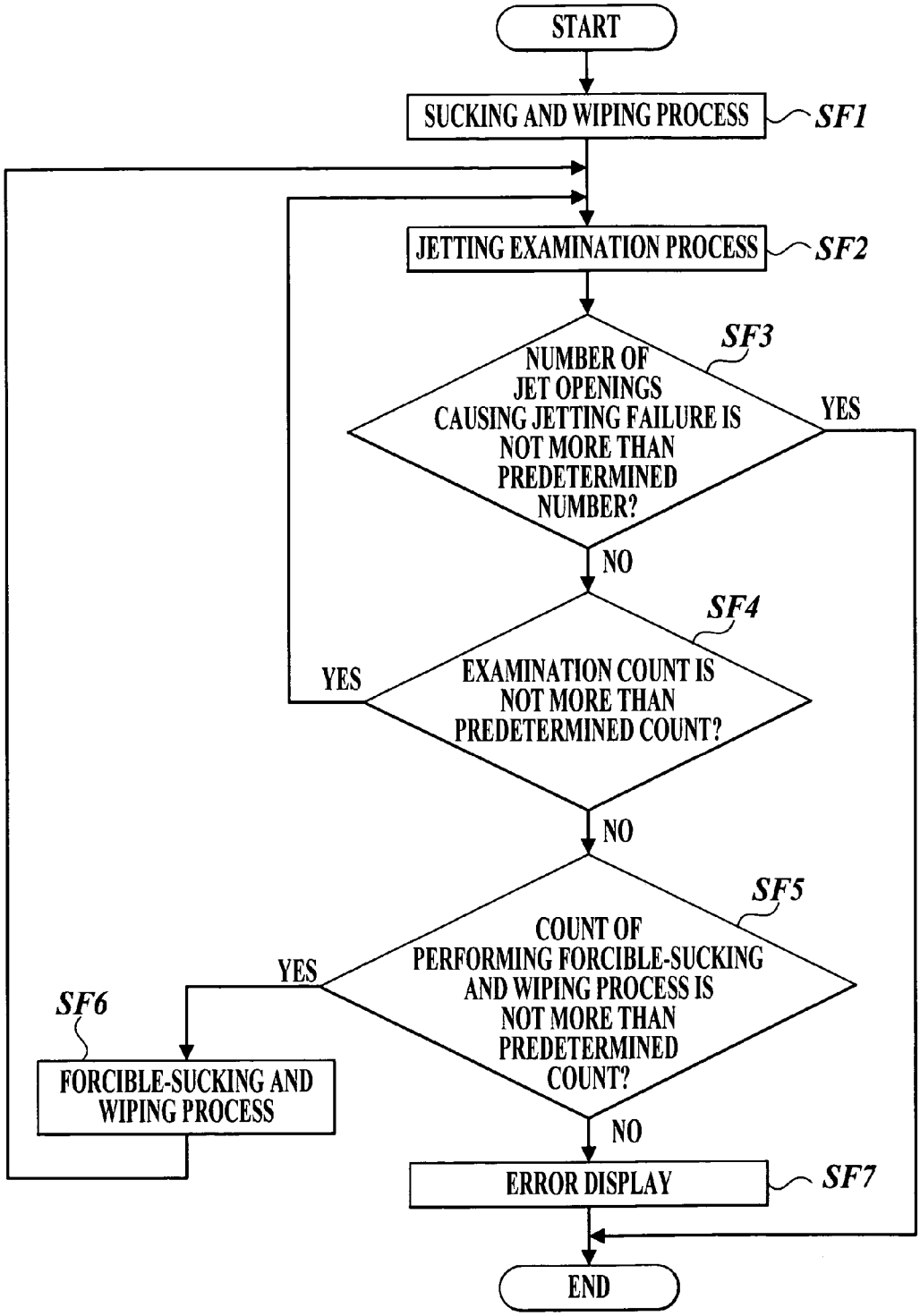
FIG. 11 is a flowchart illustrating a flow of a process of the control device 60 when the inkjet printer performs a sixth recovering operation.

A sixth recovering operation among the nine types of recovering operations will be described with reference to FIG. 11. FIG. 11 is a flowchart illustrating a recovering processing mode performed by the control device at the sixth recovering operation, with time.

[Step SF1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SF1 is the same as the process in Step SA1 of the first recovering processing mode.

[Step SF2: Jetting Examination Process]

Following Step SF1, the control device 60 counts the number of jet openings causing jetting failure of the recording heads 7 to 10. The process of the control device 60 in Step SF2 is the same as the process in Step SA2 of the first recovering processing mode.

[Step SF3: Comparing Process]

Following Step SF2, the control device 60 compares the number of jet openings causing jetting failure counted in Step SF2 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the control device 60 counts up the examination count, and the process of the control device 60 is transferred to Step SF4. Here, after Step SF3, when the process of the control device 60 is completed and when the host computer 80 inputs image data to the control device 60, the inkjet printer 1 performs the above-described [1. image recording operation].

[Step SF4: Examination Count Comparing Process]

In Step SF4, the control device 60 compares the examination count which is counted up in Step SF3 with predetermined count I. If the control device 60 judges that the examination count is not more than the predetermined count I according to the comparison result, the process of the control device 60 returns to Step SF2, and the control device 60 performs the process of Step SF2 again. Therefore, until the examination count exceeds the predetermined count I, the control device 60 performs the processes of Step SF2 and Step SF3. On the other hand, if the examination count exceeds the predetermined count I by repeating Step SF2 and Step SF3, the process of the control device 60 is transferred to Step SF5. Here, while the control device 60 is repeating the processes of Steps SF2 and SF3, if the number of jet openings causing jetting failure is not more than the predetermined number M (Step SF3; Yes), the process of the control device 60 is finished, and the recovering operation of the inkjet printer 1 is completed.

[Step SF5: Forcible Sucking and Wiping Process Count Comparing Process]

In Step SF5, the control device 60 compares a count of performing a forcible-sucking and wiping process, the count being counted up in the later-described Step SF6, with a predetermined number K. If the control device 60 judges that the count of performing the forcible-sucking and wiping process is not more than the predetermined number K according to the comparison result, the process of the control device 60 is transferred to Step SF6 and to Step SF2, and the control device 60 performs the process of Step SF2 again. Therefore, until the count of performing the forcible-sucking and wiping process exceeds the predetermined number K, the control device 60 repeats the processes of Step SF2 to Step SF6. On the other hand, if the count of performing the forcible-sucking and wiping process exceeds the predetermined number K by repeating from Step SF2 to Step SF6, the process of the control device 60 is transferred to Step SF7.

[Step SF6: Forcible-Sucking and Wiping Process]

In Step SF6, the sucking and wiping process is performed as well as the case of Step SF1. However, when the control device 60 actuates the sucking pump 50, a sucking force of the sucking pump 50 is made higher than the sucking force of the sucking pump 50 in a former sucking and wiping process. Here, the former sucking and wiping process is, when the process of Step SF6 is performed at the first time, the sucking and wiping process of Step SF1, or when the process of Step SF6 is performed at the second time or later, the sucking and wiping process of Step SF6. Here, after Step SF6, the process of the control device 60 returns to Step SF2.

[Step SF7: Error Process]

In Step SF7, the control device 60 transmits an error signal to the host computer 80, and the host computer 80 performs an error display. Then, the process of the control device 60 is finished. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

As mentioned, also in the sixth recovering operation, after the sucking and wiping process of Step SF1 is performed, the jetting examination process of Step SF2, which counts the number of jet openings causing jetting failure, is performed, wherein the jetting examination process is repeatedly performed if the number of jet openings causing jetting failure exceeds the predetermined number. Therefore, while the jetting examination process is repeated, the number of jet openings causing jetting failure is reduced. Further, when the count of performing the jetting examination process of Step SF2 exceeds the predetermined count I, since the sucking is performed with a higher forcible-sucking force in Step SF6, it is possible to eliminate jet openings causing jetting failure more surely and quickly. Further, since the sucking process of Step SF1 does not involve a high sucking force, it is possible to prevent from wasting ink.

[2-7. Seventh Recovering Operation]

Figure 12:
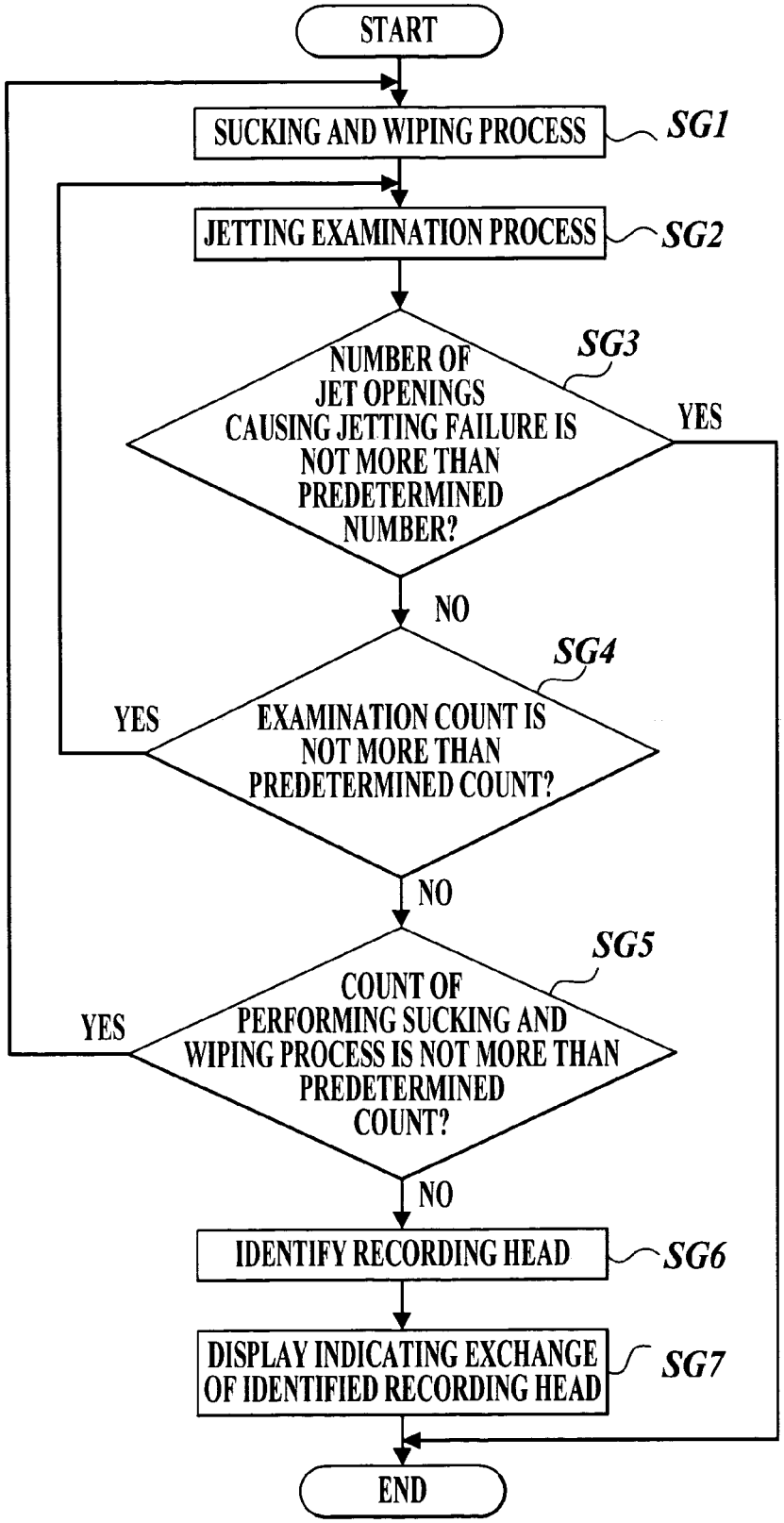
FIG. 12 is a flowchart illustrating a flow of a process of the control device 60 when the inkjet printer performs a seventh recovering operation.

A seventh recovering operation among the nine types of recovering operations will be described with reference to FIG. 12. FIG. 12 is a flowchart illustrating a seventh recovering processing mode performed by the control device 60 at the seventh recovering operation, with time.

[Step SG1: Sucking and Wiping Process]

The control device 60 performs a sucking and wiping process of the recording heads 7 to 10 at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SG1 is the same as the process in Step SA1 of the first recovering processing mode. However, in the Step SG1, after performing the sucking and wiping process, the control device 60 counts up the count of performing the sucking and wiping process.

[Step SG2: Jetting Examination Process]

Following Step SG1, the control device 60 counts the number of jet openings causing jetting failure of the recording heads 7 to 10. The process of the control device 60 in Step SG2 is the same as the process in Step SA2 of the first recovering processing mode.

[Step SG3: Comparing Process]

Following Step SG2, the control device 60 compares the number of jet openings causing jetting failure counted in Step SG2 with the predetermined number M. If the control device 60 judges that the number of jet openings causing jetting failure is not more than the predetermined number M according to the comparison result, the process of the control device 60 is finished, and the recovering operation of the inkjet printer 1 is completed. On the other hand, if the control device 60 judges that the number of jet openings causing jetting failure is more than the predetermined number M according to the comparison result, the control device 60 counts up the number of examination count, and the process of the control device 60 is transferred to Step SG4. Here, after Step SG3, when the process of the control device 60 is completed and when the host computer 80 inputs image data to the control device 60, the inkjet printer 1 performs the above-described [1. image recording operation].

[Step SG4: Examination Count Comparing Process]

In Step SG4, the control device 60 compares the examination count which is counted up in Step SG3 with predetermined count I. If the control device 60 judges that the examination count is not more than the predetermined count I according to the comparison result, the process of the control device 60 returns to Step SG2, and the control device 60 performs the process of Step SG2 again. Therefore, until the examination count exceeds the predetermined count I, the control device 60 repeats the processes of Step SG2 and Step SG3. On the other hand, if the examination count exceeds the predetermined count I by repeating Step SG2 and Step SG3, the process of the control device 60 is transferred to Step SG5. Here, while the control device 60 is repeating the processes of Step SG2 and SG3, if the number of jet openings causing jetting failure is not more than the predetermined number M (Step SG3; Yes), the process of the control device 60 is finished, and the recovering operation of the inkjet printer 1 is completed.

[Step SG5: Sucking and Wiping Process Count Comparing Process]

In Step SG5, the control device 60 compares the count of performing the sucking and wiping process counted up in Step SG1 with predetermined count J. If the control device 60 judges that the count of performing the sucking and wiping process is not more than the predetermined count J according to the comparison result, the process of the control device 60 returns to Step SG1, and the control device 60 performs the process of Step SG1 again. Therefore, until the count of performing the sucking and wiping process exceeds the predetermined count J, the control device 60 repeats the processes from Step SG1 to Step SG4. On the other hand, if the count of performing the sucking and wiping process exceeds the predetermined count J by repeating from Step SG1 to Step SG4, the process of the control device 60 is transferred to Step SG6.

[Step SG6: Identifying Process]

In Step SG6, with the control device 60 making the jetting examination sensor 32 examine whether there is any jet opening causing jetting failure among all the jet openings of the recording heads 7 to 10, the number of jet openings causing jetting failure is counted with respect to each of the recording heads 7 to 10, and a recording head whose number of jet openings causing jetting failure is more than predetermined count is identified among the recording heads 7 to 10. Then, the process of the control device 60 is transferred to Step SG7.

[Step SG7: Error Process Indicating Exchange of Identified Recording Head]

In Step SG7, the control device 60 transmits an error signal indicating exchange of the recording head identified in Step SG6 to the host computer 80, and the host computer 80 performs an error display indicating exchange of the identified recording head. Then, the process of the control device 60 is finished. Here, the control device 60 may be connected to a display device to perform the error display indicating exchange of the identified recording head on the display device, or the control device 60 may be connected to a buzzer to output an error sound indicating exchange of the identified recording head from the buzzer, or the control device 60 may be connected to a light so that the control device 60 makes the light illuminate or blink to show the error indicating exchange of the identified recording head.

As mentioned, also in the seventh recovering operation, after the sucking and wiping process of Step SG1 is performed, the jetting examination process of Step SG2, which counts the number of jet openings causing jetting failure, is performed, wherein the jetting examination process is repeatedly performed when the number of jet openings causing jetting failure exceeds the predetermined number M. Therefore, while the jetting examination process is being repeated, the number of jet openings causing jetting failure is reduced. Further, when the count of performing the jetting examination process exceeds the predetermined count I, a recording head whose number of jet openings causing jetting failure is more than predetermined count Is identified among the recording heads 7 to 10, and a display indicating exchange of the identified recording head is performed. Therefore, it is possible to prompt a user to exchange the head with the display.

[2-8. Eighth Recovering Operation]

Figure 13:
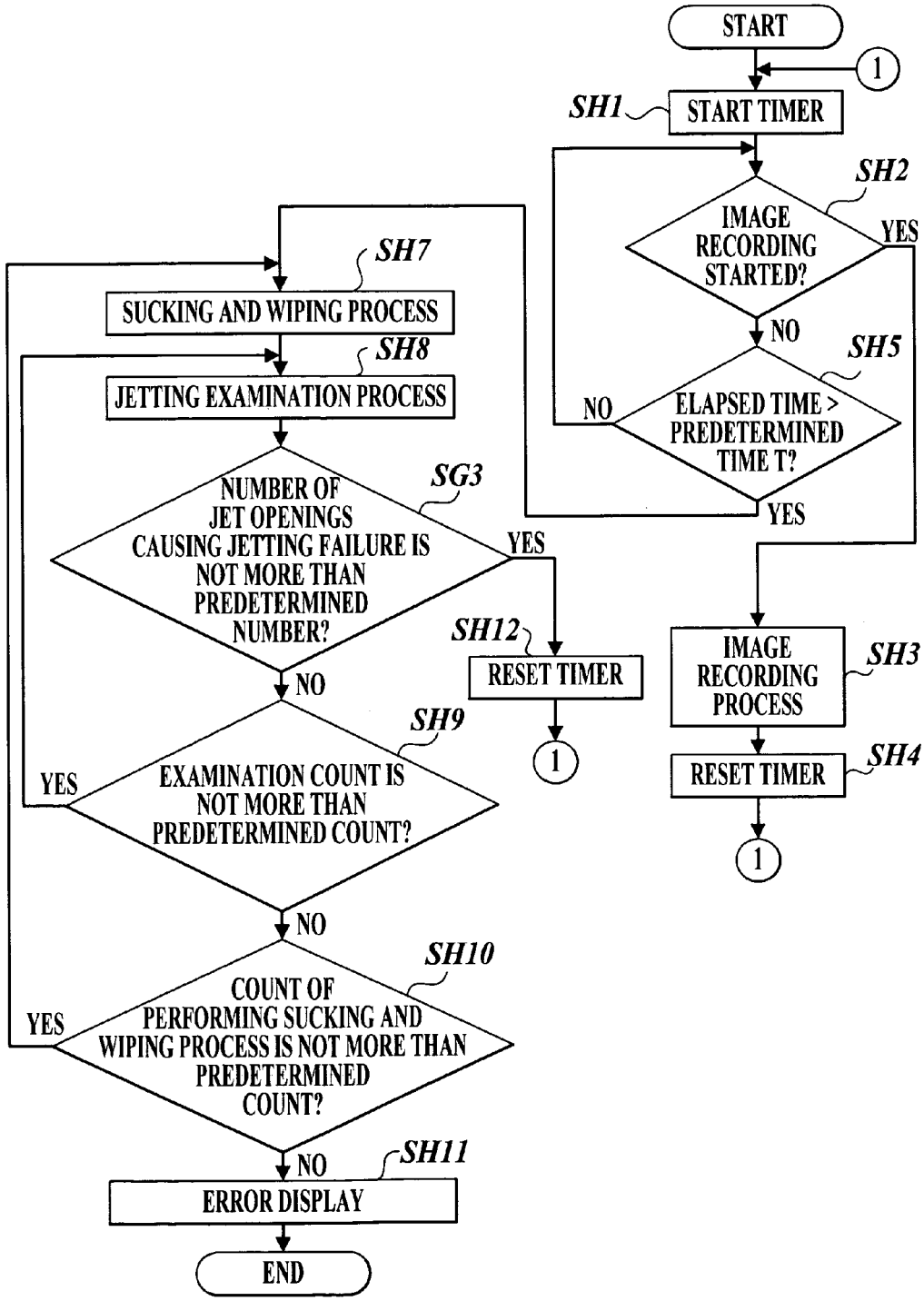
FIG. 13 is a flowchart illustrating a flow of a process of the control device 60 when the inkjet printer performs an eighth recovering operation.

An eighth recovering operation among the nine types of recovering operations will be described with reference to FIG. 13. FIG. 13 is a flowchart illustrating an eighth recovering processing mode performed by the control device 60 at the eighth recovering operation, with time.

[Step SH1: Time Measurement Starting Process]

When the above-described [1. image recording operation] is completed, the control device 60 makes a timer 65 start time measurement.

[Step SH2: Image Recording Start Judging Process]

While the timer 65 is doing the time measurement, the control device 60 judges whether an image recording start signal is received from the host computer 80. Here, if the image recording start signal is inputted to the control device 60, the process of the control device 60 is transferred to Step SH3. On the other hand, if the image recording start signal is not inputted to the control device 60, the process of the control device 60 is transferred to Step SH5.

[Step SH3: Image Recording Process]

In Step SH3, the control device 60 receives image data from the host computer 80 and the inkjet printer 1 performs the above-described [1. image recording operation]. Thereafter, the process of the control device 60 is transferred to Step SH4. Here, when the process is transferred from Step SH2 to Step SH3, the control device 60 may perform a process which is identical to the process of Step SA2 in the first recovering processing mode after Step SH2 and before SH3.

[Step SH4: Time Measurement Resetting Process]

In Step SH4, the control device 60 resets the time measurement of the timer 65. Thereafter, the process of the control device 60 returns to Step SH1, and as described above, the control device 60 makes the timer 65 start the time measurement in Step SH1.

[Step SH5: Measured Time Judging Process]

In Step SH5, the control device 60 judges whether predetermined time T has passed since the time measurement start in Step SH1. Then, if the predetermined time T has not passed since the time measurement start, the process of the control device 60 returns to Step SH2. Then, if the predetermined time T has passed since the time measurement start, the process of the control device 60 is transferred to Step SH6.

[Step SH6: Sucking and Wiping Process]

In Step SH6, the control device 60 performs the sucking and wiping process of the recording heads 7 to 10. The process of the control device 60 in Step SH6 is the same as the process of the Step SA1 in the first recovering processing mode. However, in Step SH6, after performing the sucking and wiping process, the control device 60 counted up the count of performing the sucking and wiping process.

[Step SH7: Jetting Examination Process]

Following Step SH6, the control device 60 counts the number of jet openings causing jetting failure of the recording heads 7 to 10. The process of the control device 60 in Step SH7 is the same as the process of Step SA1 in the first recovering processing mode.

[Step SH8: Comparing Process]

Following Step SH6, the control device 60 compares the counted number of jet openings causing jetting failure with predetermined number M. If the control device 60 judges that the number of jet openings causing jetting failure is not more than the predetermined number M according to the comparison result, the process of the control device 60 is transferred to Step SH12. On the other hand, if the control device 60 judges that the number of jet openings causing jetting failure is more than the predetermined number M according to the comparison result, the control device 60 counts up the examination count and the process of the control device 60 is transferred to Step SH9.

[Step SH9: Examination Count Comparing Process]

In Step SH9, the control device 60 compares the examination count which is counted up in Step SH8 with predetermined count I. If the control device 60 judges that the examination count is not more than the predetermined count I according to the comparison result, the process of the control device 60 returns to Step SH7, and the control device 60 performs the process of Step SH7 again. Therefore, until the examination count exceeds the predetermined count I, the control device 60 repeats the processes of Step SH7 and Step SH8. On the other hand, if the examination count exceeds the predetermined count I by repeating Step SH7 and Step SH8, the process of the control device 60 is transferred to Step SH10. Here, while the control device 60 is repeating the processes of Step SH7 and SH8, if the number of jet openings causing jetting failure is not more than the predetermined number M (Step SH8; Yes), the process of the control device 60 is finished, and the recovering operation of the inkjet printer 1 is completed.

[Step SH10: Sucking and Wiping Process Count Comparing Process]

In Step SH10, the control device 60 compares the count of performing the sucking and wiping process counted up in Step SH6 with predetermined count J. If the control device 60 judges that the count of performing the sucking and wiping process is not more than the predetermined count J according to the comparison result, the process of the control device 60 returns to Step SH6, and the control device 60 performs the process of Step SH6 again. Therefore, until the count of performing the sucking and wiping process exceeds the predetermined count J, the control device 60 repeats the processes from Step SH6 to Step SH10. On the other hand, if the count of performing the sucking and wiping process exceeds the predetermined count J by repeating from Step SH6 to Step SH10, the process of the control device 60 is transferred to Step SH11.

[Step SH11: Error Process]

In Step SH11, the control device 60 transmits an error signal to the host computer 80, and the host computer 80 performs an error display. Then, the process of the control device 60 is finished. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

[Step SH12: Time Measurement Resetting Process]

In Step SH12, the control device 60 resets the time measurement of the timer 65. Thereafter, the process of the control device 60 returns to Step SH1, and as described above, the control device 60 makes the timer 65 start the time measurement in Step SH1.

As mentioned, also in the eighth recovering operation, after the sucking and wiping process of Step SH6 is performed, the jetting examination process of Step SH7, which counts the number of jet openings causing jetting failure, is performed, wherein the jetting examination process is repeatedly performed when the number of jet openings causing jetting failure is more than the predetermined number M. Therefore, while the jetting examination process is being repeated, the number of jet openings causing jetting failure is reduced. Further, although there is a possibility of causing jetting failure due to viscosity increase of ink existing at each jet opening of the recording heads 7 to 10 after the image recording process of Step SH3, since the sucking and wiping process of Step SH6 is performed after predetermined time has passed since the image recording process, it is possible to suppress jetting failure at a jet opening due to viscosity increase.

[2-9. Ninth Recovering Operation]

Figure 14A:
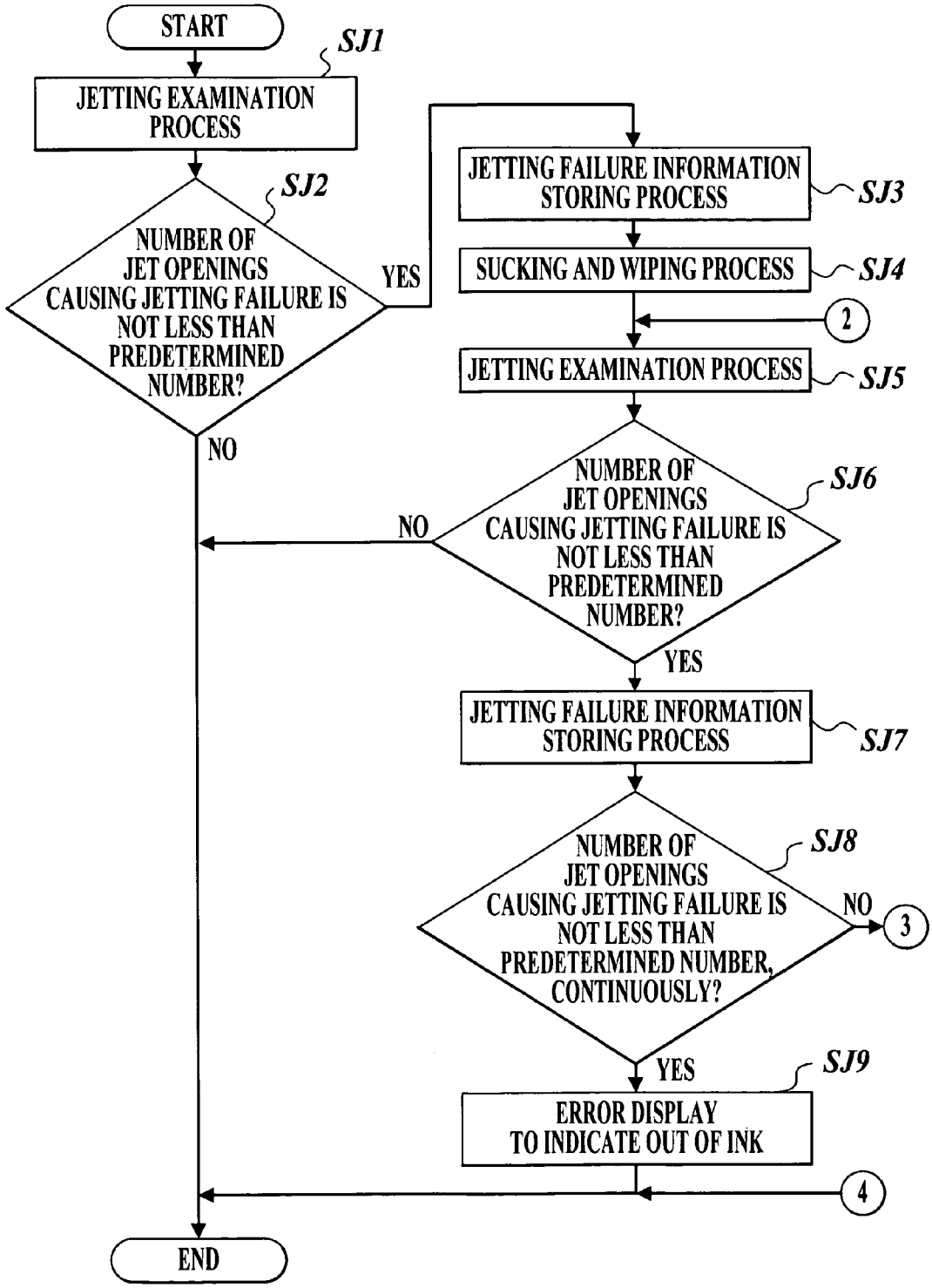
FIGS. 14A and 14B are a flowchart illustrating a flow of a process of the control device 60 when the inkjet printer performs a ninth recovering operation.
Figure 14B:
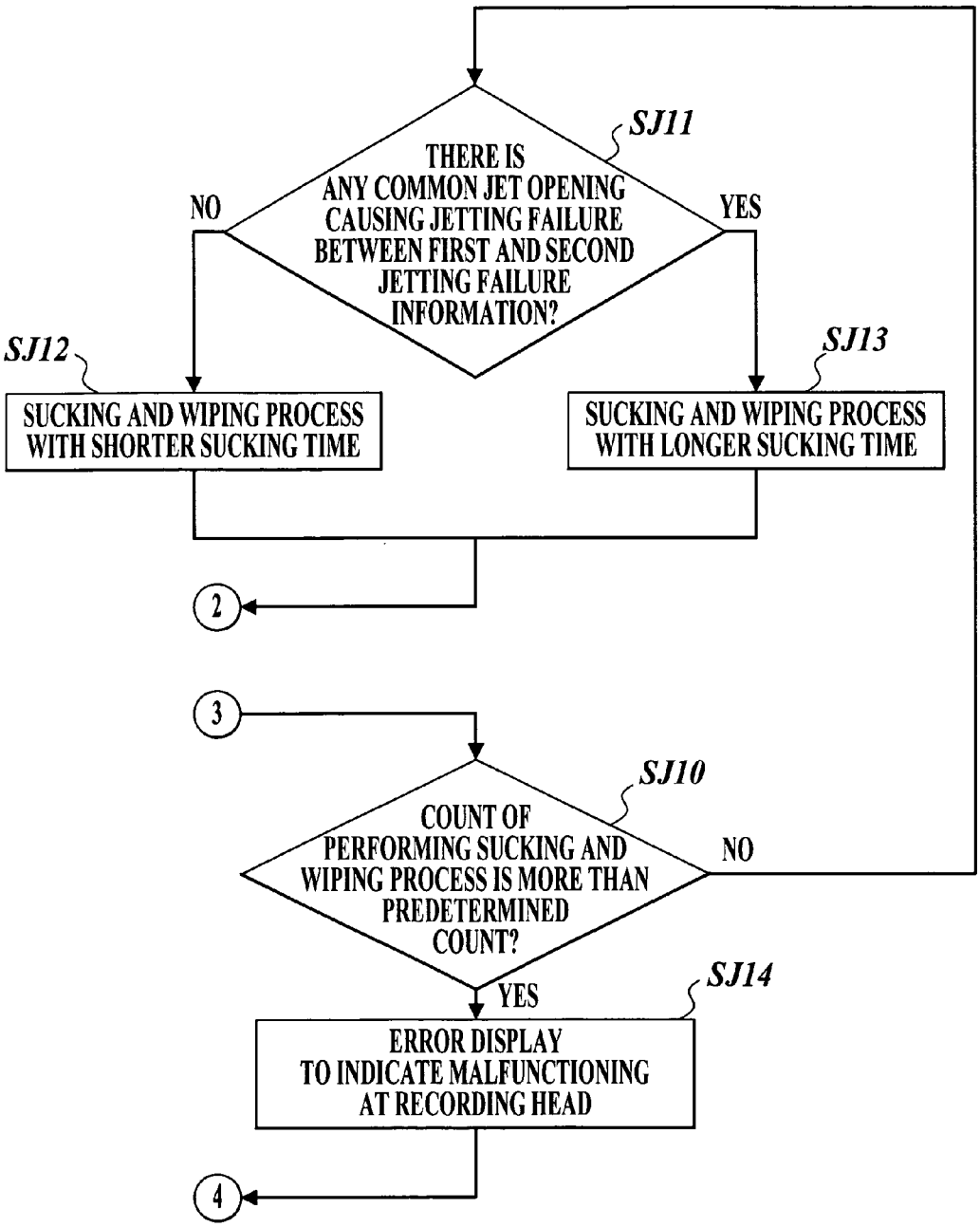

A ninth recovering operation among the nine types of recovering operations will be described with reference to FIGS. 14A and 14B. FIGS. 14A and 14B are a flowchart illustrating a ninth recovering processing mode performed by the control device 60 at the ninth recovering operation, with time.

Here, in the ninth recovering operation, a recovering transition will be described only with respect to one recording head, which is the recording head 7.

[Step SJ1: Jetting Examination Process]

The control device 60 examines whether there is any jet opening causing jetting failure among all the jet openings of the recording head 7 and counts the number of jet openings causing jetting failure, at the time of: turning on the power of the inkjet printer 1; pushing the start input button by a user; inputting an image recording start signal to the control device 60 from the host computer 80 (before the above-mentioned [1. image recording operation]), or the like. The process of the control device 60 in Step SJ1 is the same as the process in Step SA2 of the first recovering processing mode.

[Step SJ2: Judging Process]

When the jetting examination process of Step SJ1 is completed, the control device 60 judges whether the number of jet openings causing jetting failure counted up in Step SJ1 is not less than predetermined number K1. If the control device 60 judges that the number of jet openings causing jetting failure is less than the predetermined number K1 according to the judgment result (Step SJ2; NO), it is determined that a recovering operation from jetting failure is not necessary except for the simulated jetting, and the control device 60 makes all the jet openings of the recording head 7 jet ink for performing the simulated jetting again. Then, the process of the control device 60 is finished, and the recovering operation of the inkjet printer 1 is completed. On the other hand, if the control device 60 judges that the number of jet openings causing jetting failure is not less than the predetermined number K1 according to the judgment result (Step SJ2; YES), the process of the control device 60 is transferred to Step SJ3.

[Step SJ3: Jetting Failure Information Storing Process]

In Step SJ3, due to the fact that it is determined that a recovering operation from jetting failure is necessary in addition to the simulated jetting, the control device 60 stores jetting failure information regarding a jet opening causing jetting failure (information regarding the total number, locations and the like of jet openings causing jetting failure, hereafter, it is referred to as "first jetting failure information") in the main memory 62 as data, based on a detection result by the jetting examination sensor 32.

[Step SJ4; Sucking and Wiping Process]

Following Step SJ3, the control device 60 performs the sucking and wiping process of the recording head 7. The process of the control device 60 in Step SJ4 is the same as the process of Step SA1 in the first recovering processing mode. In Step SJ4, after performing the sucking and wiping process, the control device 60 counts up the count of performing the sucking and wiping process.

Here, in the sucking and wiping process in Step SJ4, ink sucking time from each jet opening of the recording head 7 (operation time of the sucking pump 50) is, for example, set to 5 seconds.

[Step SJ5: Jetting Examination Process]

Following Step SJ4, the control device 60 counts the number of jet openings causing jetting failure among all the jet openings of the recording head 7. The process of the control device 60 in Step SJ5 is the same as the process of Step SA2 in the first recovering processing mode.

[Step SJ6: Judging Process]

Following Step SJ5, the control device 60 judges whether the number of jet openings causing jetting failure counted up in Step SJ5 is not less than the predetermined number K1. If the control device 60 judges that the number of jet openings causing jetting failure is less than the predetermined number K1 according to the judgment result (Step SJ6; NO), it is determined that a recovering operation from jetting failure is not necessary except for the simulated jetting, and the control device 60 makes all the jet openings of the recording head 7 jet ink for performing the simulated jetting again. Then, the process of the control device 60 is finished, and the recovering operation of the inkjet printer 1 is completed. On the other hand, if the control device 60 judges that the number of jet openings causing jetting failure is not less than the predetermined number K1 according to the judgment result (Step SJ6; YES), the process of the control device 60 is transferred to Step SJ7.

[Step SJ7: Jetting Failure Information Storing Process]

In Step SJ7, due to the fact that it is determined that a recovering operation from jetting failure is necessary in addition to the simulated jetting, the control device 60 stores jetting failure information regarding a jet opening causing jetting failure (information regarding the total number, locations and the like of jet openings causing jetting failure, hereafter, it is referred to as "second jetting failure information") in the main memory 62 as data, based on a detection result by the jetting examination sensor 32.

Here, the predetermined number K1, which is used for the judgment in the processes of Step SJ2 and Step SJ6, can be suitably set according to image quality in connection with the described [1. image recording operation]. For example, it can be set to one-tenth of the number of all the jet openings, or can be set to 1, extremely speaking. In other words, if the predetermined number K1 is set to one-tenth of the number of all the jet openings, when it is judged that the number of jet openings causing jetting failure is not less than one-tenth of the number of all the jet openings, the first jetting failure information storing process and the second jetting failure information storing process are performed. Further, if the predetermined number K1 is set to 1, if it is judged that there is at least one jet opening causing jetting failure, the first jetting failure information storing process and the second jetting failure information storing process are performed. By making the predetermined number K1 smaller, more accurate detection of jetting failure can be obtained, whereby it is possible to improve image quality in connection with the described [1. image recording operation].

[Step SJ8: Judging Process]

Following Step SJ7, in consideration with the first jetting failure information and the second jetting failure information, the control device 60 judges whether the total number of jet openings causing jetting failure is continuously not less than the predetermined number K1 (for example, one-third of the number of all the jet openings of the recording head 7) through the ink simulated jetting operations based on each of the processes of Step SJ1 and Step SJ5. If the control device 60 judges that the total number of jet openings causing jetting failure is continuously not less than the predetermined number K1 according to the judgment result (Step SJ8; YES), the process of the control device 60 is transferred to Step SJ9. On the other hand, if the control device 60 judges that the total number of jet openings causing jetting failure does not continuously reach the predetermined number K1 (Step SJ8; NO), the process of the control device 60 is transferred to Step SJ10.

[Step SJ9: Error Process]

In Step SJ9, the control device 60 transmits an error signal indicating that the recording head 7 is out of ink to the host computer 80, and the host computer 80 performs an error display indicating that the recording head 7 is out of ink. Since it is judged that the number of jet openings causing jetting failure is continuously not less than the predetermined number K1 through the two times of ink simulated jetting operations, which are respectively the processes of Step SJ1 and Step SJ5, it is judged that "out of ink" happens in the recording head and a user is notified accordingly from the error display. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

[Step SJ10: Judging Process]

In Step SJ10, the control device 60 judges whether the count of performing the sucking and wiping process counted up in Step SJ4, SJ12 and SJ13 (count of performing the sucking and wiping process to the recording head 7) reaches a predetermined count K2 (not less than two times). If the control device 60 judges that the count of performing the sucking and wiping process to the recording head 7 reaches the predetermined count K2 according to the judgment result (Step SJ10; YES), the process of the control device 60 is transferred to Step SJ14. On the other hand, if the control device 60 judges that the count of performing the sucking and wiping process to the recording head 7 does not reach the predetermined count K2 (Step SJ10; NO), the process of the control device 60 is transferred to Step SJ11.

[Step SJ14: Error Process]

In Step SJ14, the control device 60 transmits an error signal indicating malfunctioning at the recording head 7 to the host computer 80, and the host computer 80 performs an error display indicating the malfunctioning at the recording head 7. In the processes of Step SJ10 and Step SJ14, since it is judged that the count of performing the sucking and wiping process in connection with jetting failure of the recording head reaches the predetermined count K2, it is judged that the jetting failure of jet openings is not recovered despite performing the sucking and wiping process to the recording head 7 not less than two times, that is, it is judged that "malfunctioning is occurring at the recording head 7", and a user is notified accordingly from the error display. Here, the control device 60 may be connected to a display device to perform the error display on the display device, or the control device 60 may be connected to a buzzer to output an error sound from the buzzer, or the control device 60 may be connected to a light so that the control device 60 makes the light illuminate or blink to show the error.

[Step SJ11: Judging Process]

In Step SJ11, in consideration with the first jetting failure information and the second jetting failure information, the control device 60 judges whether there is any common positioned jet opening among jet openings which are judged to be causing jetting failure according to the two times of ink simulated jetting operations based on each of the processes of Step SJ2 and SJ6.

Figure 15:
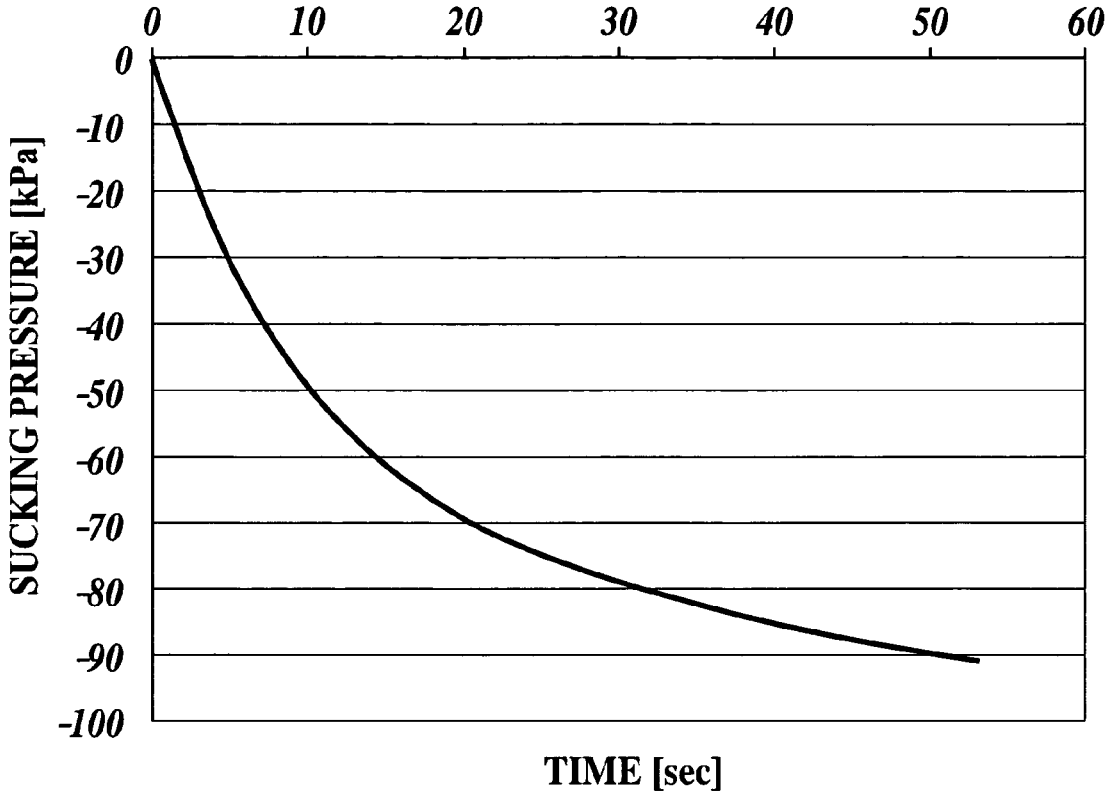
FIG. 15 is a graph showing a pump characteristic of a sucking pump 50 as one example.

Here, it is assumed that the sucking pump 50 is a pump having a pump characteristic of FIG. 15. FIG. 15 shows a relation between elapsed time [sec] since the start of sucking by the sucking pump 50 and a sucking force [kPa] of the sucking pump 50. As shown in FIG. 15, with the sucking pump 50, it is possible to change a sucking force of ink according to the length of sucking time. With reference to the pump characteristic of FIG. 15, the sucking force reaches 30 kPa at five seconds after the sucking start. Accordingly, as mentioned, if the sucking time is set to five seconds in the process of Step SJ4, a sucking force is set to 30 kPa in the process of Step SJ4.

If the control device 60 judges that there is no common-positioned jet opening according to the judgment result (Step SJ11; NO), the process of control device 60 is transferred to Step SJ12. On the other hand, if the control device 60 judges that there is at least one common-positioned jet opening according to the judgment result (Step SJ11; YES), the process of the control device 60 is transferred to Step SJ13.

[Step SJ12: Sucking and Wiping Process]

In Step SJ12, the control device 60 performs the sucking and wiping process to the recording head 7 so as to make a sucking force of ink equal to or lower than the sucking force at the time of performing former sucking and wiping process, that is, the control device 60 performs the sucking and wiping process to the recording head 7 so as to make ink sucking time (operating time of the sucking pump 50) equal to or shorter than 5 seconds. The process of the control device 60 in Step SJ12 is the same as the process in Step SA1 of the first recovering processing mode except that a sucking force thereof is made equal to or lower than that of a former sucking and wiping process. However, in Step SJ12, after performing the sucking and wiping process, the control device 60 counts up the count of performing the sucking and wiping process.

The reason why a sucking force of ink in Step SJ12 is made equal to or lower than that of a former sucking and wiping process (here, the process of Step SJ4) is, it is considered that air bubble is generated at a jet opening, and therefore, it is considered that it is possible to recover the jet opening from jetting failure by making a sucking force corresponding to sucking time equal to or lower than that of a former sucking and wiping process.

[Step SJ13: Sucking and Wiping Process]

In Step SJ13, the control device 60 performs the sucking and wiping process to the recording head 7 so as to make a sucking force of ink higher than that of a former sucking and wiping process, that is, the control device 60 performs the sucking and wiping process to the recording head 7 so as to make ink sucking time (operating time of the sucking pump 50) longer than 5 seconds. The process of the control device 60 in Step SJ13 is the same as the process in Step SA1 of the first recovering processing mode except that a sucking force thereof is made higher than that of the former sucking and wiping process. However, in Step SJ13, after performing the sucking and wiping process, the control device 60 counts up the count of performing the sucking and wiping process.

The reason why a sucking force of ink is made higher than that of a former sucking and wiping process (here, the process of Step SJ4) is, it is considered that foreign material is clogging at the common jet opening, and therefore, it is considered that it is not possible to recover the jet opening from jetting failure (clogging of foreign material) unless a sucking force corresponding to sucking time is made higher than that of a former sucking and wiping process.

In the process of Step SJ13, for example, if ink sucking time is set to 15 seconds, it is possible to suck ink with the sucking force (60 kPa) which is twice as much as the sucking force in the process of Step SJ4 (30 kPa).

When finishing the process of either Step SJ12 or Step SJ13, the control device 60 repeats the processes from Step SJ5 to Step SJ12 or the processes from Step SJ5 to Step SJ13. In this case, when the processes of SJ8, SJ10 and SH11 are to be performed again, the control device 60 makes the judgment by comparing jetting failure information stored in the process of former Step SJ7 (second jetting failure information) and jetting failure information stored in the process of current Step SJ7 (hereafter, it is referred to as "third jetting failure information").

Further, when the processes of Step SJ12 and Step SJ13 are to be performed again, the control device 60 makes the judgment by comparing with a sucking force in former Steps SJ12 and SJ13.

For example, as well as the above-described case, it is assumed that the sucking pump 50 is a pump having the pump characteristic of FIG. 15. If ink sucking time in the process of Step SJ13 at the first time is set to 15 seconds, a sucking force reaches 60 kPa at 15 seconds after the sucking start. Accordingly, if the control device 60 judges that there is no common-positioned jet opening in the process of Step SJ11 at the second time, the control device 60 performs the same process as Step SA1 in which a sucking force of ink is made equal to or lower than the sucking force of the former sucking and wiping process, that is, the same process as Step SA1 in which ink sucking time is made equal to or shorter than 15 seconds.

On the other hand, if the control device 60 judges that there is at least one common-positioned jet opening in the process of SJ11 at the second time, the control device 60 performs the same process as Step SA1 in which a sucking force of ink is made higher than the former sucking and wiping process, that is, the same process as Step SA1 in which ink sucking time is made longer than 15 seconds.

In the process of Step SJ13 at the second time, for example, if ink sucking time is set to 50 seconds, it is possible to suck ink with a sucking force (90 kPa) which is 1.5 times higher than the sucking force in the process of Step SJ13 at the first time (60 kPa).

Then, with respect to the process of Step SJ10 thereafter, for example, if the predetermined count K2 for performing the sucking and wiping process is set to "three times", since the count of performing the sucking and wiping process to the recording head 7 at the time of performing the processes of Step SJ12 and Step SJ13 at the first time is two times, which are the process of Step SJ4 and the process of either Step SJ12 or Step SJ13 at the first time, in this case, the control device 60 does not perform the process of Step SJ14. However, since the process of either Step SJ12 or Step SJ13 is performed at the second time, the count of performing the sucking and wiping process to the recording head 7 is three times. Therefore, at this time, it is judged that malfunctioning is happening to the recording head, and the process of Step SJ14 is performed.

Here, in the above, described is the detail of the recovering operation only with respect to one recording head, which is the recording head 7. However, the control device 60 makes each of the recording heads 7 to 10 perform the same recovering operation simultaneously. In this case, if there are jet openings causing jetting failure more than the predetermined number K1 in at least one of the recording heads 7 to 10, the above-described ninth recovering operation is performed only with respect to the recording head having the jet openings causing jetting failure, among the recording heads 7 to 10. With respect to the other recording heads among the recording heads 7 to 10, the above-described ninth recovering operation is not performed. At this time, if there are jet openings causing jetting failure more than the predetermined number K1 in at least two of the four recording heads 7 to 10, sucking time (sucking force) of each of sucking pumps 50 that corresponds to the recording heads having the jet openings causing jetting failure among the recording heads 7 to 10 may be changed independently. Further, if the control device 60 makes the plurality of recording heads 7 to 10 perform the ink sucking operation simultaneously, the sucking operation of the recording heads 7 to 10 is performed according to sucking time of a recording head having the highest sucking force, and when the ink sucking operation to the recording heads 7 to 10 is completed, the control device 60 makes the wiper blades 42 to 45 eliminate the ink.

As mentioned, in the ninth recovering operation, based on the continuous two pieces of jetting failure information, that are, the first and second jetting failure information, the second and third jetting failure information and the like, if there is no common-positioned jet opening among jet openings causing jetting failure, it is judged that the cause of jetting failure is generation of air bubble. Then, a sucking operation is later performed with a sucking force which is equal to or lower than that of the former sucking operation, whereby, it is possible to suppress the amount of ink to be dumped. On the other hand, if there is a common-positioned jet opening among jet openings causing jetting failure, it is judged that the cause of jetting failure is clogging of foreign material. Then, a sucking operation is later performed with a sucking force which is higher than that of the former sucking operation, whereby, it is possible to more surely eliminate foreign material. Accordingly, it is possible to recover a jet opening causing jetting failure in accordance with a cause of the jetting failure.

Further, in the ninth recovering operation, in addition to recovering a jet openings causing jetting failure, based on continuous two pieces of jetting failure information, that are, the first and second jetting failure information, the second and third jetting failure information and the like, whether the sum total number of jet openings causing jetting failure is continuously not less than the predetermined number K1 is judged, and then an error display indicating the recording heads 7 to 10 are out of ink is performed. Thereby, it is possible to notify a user that the recording heads 7 to 10 are out of ink. Further, in the ninth recovering operation, whether the count of performing the sucking and wiping operation is not less than the predetermined count K2 is judged, and an error display indicating that malfunctioning is occurring to the recording heads 7 to 10. Thereby, it is possible to notify a user of the malfunctioning at the recording heads 7 to 10.

Further, in the above ninth recovering operation, described is the case that increase and decrease of a sucking force is suitably changed in accordance with sucking time of the sucking pump 50. However, increase and decrease if a sucking force may be suitably changed in accordance with grinding speed of each roller member 92 of the sucking pump 50 (rotation speed of the motor 90).

The entire disclosure of a Japanese Patent Application No. Tokugan 2004-051753 filed on Feb. 26, 2004, and a Japanese Patent Application No. Tokugan 2004-011686 filed on Jan. 20, 2004, including specifications, claims, drawings and summaries are incorporated herein by reference in their entirety.

What is claimed is:

1. An inkjet printer comprising:

a recording head which comprises a plurality of jet openings for jetting ink;

a sensor for detecting a jet opening causing jetting failure among the plurality of jet openings of the recording head;

a cleaning mechanism for cleaning the recording head; and a control section for making the sensor detect the jet opening causing jetting failure by making the recording head perform simulated jetting from each jet opening, for performing an examination process to count number of the jet opening causing jetting failure, for performing a cleaning process to make the cleaning mechanism perform a cleaning operation after the examination process is performed, for performing a second examination process which is identical to the examination process after the cleaning process is performed, for performing a judging process to compare the number of the jet opening causing jetting failure counted in the second examination process with the number of the jet opening causing jetting failure counted in the first examination process after the second examination process is performed, and for determining a cleaning mode of the cleaning process which is performed after the judging process according to a result of the judging process.

2. The printer of claim 1, wherein the cleaning mechanism comprises a sucking mechanism for sucking the ink from each jet opening of the recording head.

3. An inkjet printer comprising:

a recording head which comprises a plurality of jet openings for jetting ink;

a sensor for detecting a jet opening causing jetting failure among the plurality of jet openings of the recording head;

a cleaning mechanism for cleaning the recording head; and a control section for making the sensor detect the jet opening causing jetting failure by making the recording head perform simulated jetting from each jet opening, for performing an examination process to count number of the jet opening causing jetting failure, for performing a cleaning process to make the cleaning mechanism perform a cleaning operation after the examination process is performed, for performing a second examination process which is identical to the examination process after the cleaning process is performed, for performing a judging process to judge whether the number of the jet opening causing jetting failure counted in the second examination process is not less than predetermined number after the second examination process is performed, and for determining a cleaning mode of the cleaning process which is performed after the judging process according to a result of the judging process, wherein the control section performs a second judging process to judge whether there is a common jet opening between the jet opening causing jetting failure detected by the examination process and the jet opening causing jetting failure detected by the second examination process, and performs a process which is identical to the cleaning process except that a cleaning force thereof is larger than that of the cleaning process when it is judged in the second judging process that there is at least one common jet opening.

4. An inkjet printer comprising:

a recording head which comprises a plurality of jet openings for jetting ink;

a sensor for detecting a jet opening causing jetting failure among the plurality of jet openings of the recording head;

a cleaning mechanism for cleaning the recording head; and a control section for making the sensor detect the jet opening causing jetting failure by making the recording head perform simulated jetting from each jet opening, for performing an examination process to count number of the jet opening causing jetting failure, for performing a cleaning process to make the cleaning mechanism perform a cleaning operation after the examination process is performed, for performing a second examination process which is identical to the examination process after the cleaning process is performed, for performing a judging process to judge whether the number of the jet opening causing jetting failure counted in the second examination process is not less than predetermined number after the second examination process is performed, and for determining a cleaning mode of the cleaning process which is performed after the judging process according to a result of the judging process, wherein the control section performs a second judging process to judge whether there is a common jet opening between the jet opening causing jetting failure detected by the examination process and the jet opening causing jetting failure detected by the second examination process, and performs a process which is identical to the cleaning process except that a cleaning force thereof is smaller than that of the cleaning process when it is judged in the second judging process that there is no common jet opening.

* * * * *